US009862182B2

(12) United States Patent
Nishikawa

(10) Patent No.: US 9,862,182 B2
(45) Date of Patent: Jan. 9, 2018

(54) IMAGE RECORDING APPARATUS AND PARAMETER SETTING METHOD

(71) Applicant: FUJIFILM Corporation, Tokyo (JP)

(72) Inventor: Baku Nishikawa, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/448,598

(22) Filed: Mar. 3, 2017

(65) Prior Publication Data

US 2017/0253023 A1 Sep. 7, 2017

(30) Foreign Application Priority Data

Mar. 4, 2016 (JP) ..... 2016-042389

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC ..... B41J 2/01; B41J 2/0451; B41J 2/04556; B41J 2/04558; B41J 2/04586; B41J 2/155
See application file for complete search history.

(56) References Cited

U.S. PATENT DOCUMENTS 8,322,814 B2 * 12/2012 Hirato ..... B41J 2/0451 347/10
8,576,679 B2 * 11/2013 Nonaka ..... G11B 20/00086 369/47.15
8,824,007 B2 * 9/2014 Yamada ..... H04N 1/6097 347/14

FOREIGN PATENT DOCUMENTS

JP 2012-210773 11/2012
JP 2015-163475 9/2015

* cited by examiner

*Primary Examiner* — Anh T. N. Vo
(74) *Attorney, Agent, or Firm* — JCIPRNET

(57) ABSTRACT

An image recording apparatus includes a recording head, a recording-position information obtaining unit configured to obtain recording position information of a plurality of recording elements a plurality of times at an interval of an arbitrary period, a recording-position chronological change information calculating unit configured to calculate chronological change information of the recording position for each recording element, a medium type specifying unit configured to specify a type of a medium using the chronological change information of the recording position for each recording element, and a parameter setting unit configured to automatically set at least either one of a recording parameter and an abnormality detection parameter in correspondence with the specified type of medium.

11 Claims, 11 Drawing Sheets

IMAGE RECORDING APPARATUS AND PARAMETER SETTING METHOD

CROSS-REFERENCE TO RELATED APPLICATIONS

The present application claims priority under 35 U.S.C. §119 to Japanese Patent Application No. 2016-042389, filed on Mar. 4, 2016. The above application is hereby expressly incorporated by reference, in its entirety, into the present application.

BACKGROUND OF THE INVENTION

Field of the Invention

The present invention relates to an image recording apparatus and a parameter setting method and particularly to a control technology of a recording head.

Description of the Related Art

In an image recording apparatus including a recording head, when a medium or a base material to be used is changed, a method of setting a recording parameter such as a recording procedure or an ejection amount or the like is known. In an image recording apparatus with a single path, not only the recording parameter such as the recording procedure or the ejection amount or the like but also an abnormality detection parameter such as a threshold value used when an abnormal recording element is detected may be set.

Conventionally, by manually inputting information on the medium or the base material into the image recording apparatus by a user, the medium or the base material is set, and the parameters such as the recording procedure, the ejection amount or a detection threshold value or the like is set.

Moreover, regarding the detection of the abnormal recording element, a technology of determining presence of the abnormal recording element on the basis of an actual recording position is known. The recording position is a position where a dot which is a minimum constituent unit of an image is formed.

Japanese Patent Application Laid-Open No. 2012-210773 describes an image recording apparatus including a reflection-type optical sensor mounted on a carriage, which detects density of a dot pattern formed on the medium.

In the image recording apparatus described in Japanese Patent Application Laid-Open No. 2012-210773, a paper-type discrimination pattern and a detection pattern for a dot position shift are provided as dot patterns. Then, the paper-type discrimination pattern is read by using a reflection-type optical sensor, and a type of a medium is determined from a degree of wet expansion of the dot on the medium.

Moreover, from a reading result of the detection pattern of the dot position shift using the reflection-type optical sensor, a correction value for correcting the shift of the recording position is calculated.

The term of the image recording apparatus in this Description corresponds to the term of a printing apparatus in Japanese Patent Application Laid-Open No. 2012-210773. The term of the medium in this Description corresponds to the term of a printing sheet in Japanese Patent Application Laid-Open No. 2012-210773.

Japanese Patent Application Laid-Open No. 2015-163475 describes an image recording apparatus including a line-type recording head in which a plurality of head modules are arranged along a longitudinal direction of a recording head. In the image recording apparatus described in Japanese Patent Application Laid-Open No. 2015-163475, first, a dot pattern for detecting a dot formation position is read out by using an optical sensor.

Subsequently, by using a reading result of the optical sensor, a shift amount of an actual recording position from an ideal recording position is calculated. Then, on the basis of the calculated shift amount, a recording position of each of recording elements of the recording head is corrected.

The term of the head module in this Description corresponds to the term of a tip of Japanese Patent Application Laid-Open No. 2015-163475. The term of the image recording apparatus in this Description corresponds to the term of the recording apparatus in Japanese Patent Application Laid-Open No. 2015-163475.

The term of the recording position in this Description corresponds to the term of an ink deposition position in Japanese Patent Application Laid-Open No. 2015-163475.

The term of the recording element in this Description corresponds to the term of a nozzle in Japanese Patent Application Laid-Open No. 2015-163475.

SUMMARY OF THE INVENTION

However, if the type of the medium or the type of the base material is set and the parameters such as the recording procedure, the ejection amount or the detection threshold value or the like is set by a user's manual input of the information on the medium or the base material in the image recording apparatus, setting of the type of the medium or the type of the base material depends on the user, and the user can input wrong information on the type of the medium or the type of the base material.

Moreover, unless the detection threshold value is set properly, the recording element which is not the abnormal recording element is detected as the abnormal recording element, and there is a concern of an increase in waste sheets caused by an increase in the abnormal recording elements or excessive correction or insufficient correction caused by an increase in unnecessary masks for abnormal recording element correction.

Even if the user can arbitrarily set the detection threshold value or the like, unless a proper detection threshold value is set, there is a concern of an increase in waste sheets caused by an increase in the abnormal recording elements or abnormal correction caused by an increase in unnecessary masks for correction.

Moreover, if the detection threshold value is uniquely set by the recording position, even if variation in recording characteristics of the recording elements is relatively small, when variation in the recording positions caused by the medium or the like is relatively large, due to an influence of the variation in the recording positions caused by the medium or the like, the variation in the recording positions might exceed the detection threshold value.

In the image recording apparatus described in Japanese Patent Application Laid-Open No. 2012-210773 and the image recording apparatus described in Japanese Patent Application Laid-Open No. 2015-163475, in determination of the abnormal recording element, influences on the recording position of characteristics depending on the type of the medium such as surface roughness of the medium or the like, a foreign substance, a stain, non-uniformity of thickness or non-uniformity of a material are not considered.

In the image recording apparatus described in Japanese Patent Application Laid-Open No. 2015-163475, though the recording characteristics of each of the recording elements are corrected by using a shift amount from an ideal recording position, since the variation in the shift amount caused by the medium characteristics is not considered, the excessive correction or insufficient correction is concerned.

The present invention was made in view of the aforementioned circumstances and has an object to provide an image recording apparatus and a parameter setting method which enable setting of parameters in an image recording apparatus considering a difference in the medium.

In order to achieve the aforementioned object, the following invention aspect is provided.

An image recording apparatus in a first aspect includes: a recording head including a plurality of recording elements; a recording-position information obtaining unit that obtains recording position information a plurality of times at an interval of an arbitrary period, the recording position information including information on an actual recording position in each of the plurality of recording elements included in the recording head; a recording-position chronological change information calculating unit that calculates chronological change information of the recording position of each recording element by using the recording-position information of each recording element obtained in the recording-position information obtaining unit; a medium type specifying unit that specifies a type of a medium by using the chronological change information of the recording position of each recording element calculated in the recording-position chronological change information calculating unit; and a parameter setting unit that automatically sets a recording parameter including at least any one of an output gradation value, an abnormal recording element correction coefficient, an uneven density correction coefficient, and a halftone processing rule in correspondence with the type of the medium specified by the medium type specifying unit, automatically sets an abnormality detection parameter including at least any one of a measurement threshold value in recording-position information obtainment, an abnormality detection threshold value used for abnormality detection, and an abnormality detection procedure used for abnormality detection or automatically sets both the recording parameter and the abnormality detection parameter.

According to the first aspect, since the type of the medium is specified by using the chronological change information of the recording position, user dependence of the setting of the type of the medium can be suppressed. Moreover, since at least any one of the recording parameter corresponding to the specified type of the medium and the abnormality detection parameter is automatically set, improvement of usability is expected.

Furthermore, when the recording parameter corresponding to the type of the medium is automatically set, the unnecessary increase in the masks applied for correction is suppressed. Furthermore, the insufficient correction and excessive correction caused by the setting of the mask are suppressed.

As an example of the recording head, a liquid ejection head including a plurality of nozzle portions is cited. As an example of the recording element, a nozzle portion which ejects a liquid is cited. As an example of the recording position, a landing position of a droplet ejected from the liquid ejection head is cited.

A second aspect may be so constituted that, in the image recording apparatus of the first aspect, the recording-position information obtaining unit obtains a result of reading a recording position measurement pattern by using a reading device as recording position information, the recording position measurement pattern being recorded in the medium by using the recording head.

The arbitrary period in the recording position information obtainment may be a certain period or may be irregular. As an example of the arbitrary period, a positive number time of a conveyance period of the medium is cited.

As an example of obtainment of the recording position information, an aspect in which reading information of the reading device arranged in a rear part of the recording head is obtained is cited. As another example of the obtainment of the recording position information, an aspect in which the reading information of the reading device arranged outside of the image recording apparatus is obtained is cited.

According to the second aspect, the recording position information based on measurement of the recording position using the recording position measurement pattern can be obtained.

A third aspect may be so constituted that, in the image recording apparatus in the first aspect or in the second aspect, the recording-position chronological change information calculating unit calculates an average value of the chronological change information of the plurality of recording elements or a median value of the chronological change information of the plurality of recording elements, and the medium type specifying unit specifies the type of the medium by using the average value of the chronological change information of the plurality of recording elements calculated by using the recording-position chronological change information calculating unit or the median value of the chronological change information of the plurality of recording elements calculated by using the recording-position chronological change information calculating unit.

According to the third aspect, since the recording position information in the plurality of the recording elements is used, fluctuation of the recording-position chronological change information caused by a state of the recording element is suppressed, and improvement of accuracy of specification of the type of the medium is expected.

In the third aspect, it is preferable that an upper limit value is set to the recording-position chronological change information, and the recording-position chronological change information exceeding the upper limit value is not applied to calculation of the average value of the recording-position chronological change information or the median value of the recording-position chronological change information.

A fourth aspect may be so constituted that, in the image recording apparatus in any one of the first aspect to the third aspects, the recording-position information obtaining unit obtains the recording position information measured at an arbitrary timing by using a standard medium, the recording-position chronological change information calculating unit calculates the recording-position chronological change information corresponding to the standard medium by using the recording position information measured when the standard medium is used, and the medium type specifying unit sets a threshold value used when the type of the medium is specified and corrects the set threshold value used when the type of medium is specified by using the recording-position chronological change information corresponding to the standard medium.

According to the fourth aspect, since the threshold value when the type of the medium is specified is corrected by using the recording position information in the standard medium, even if a recording state of the recording head is changed, accuracy of specification of the type of the medium can be maintained constant.

A fifth aspect may be so constituted that, in the image recording apparatus of the fourth aspect, the medium type specifying unit determines necessity of correction of the set threshold value used when the type of the medium is specified by using the recording position information in the plurality of recording elements obtained in one session in the recording position information when the standard medium is used.

According to the fifth aspect, improvement of accuracy of the threshold value when the type of the medium is specified can be expected.

A sixth aspect may be so constituted to include, in the image recording apparatus in any one of the first aspect to the fifth aspect, an optical density information obtaining unit that obtains optical density information and a medium type segmenting unit that segments and specifies the type of the medium specified by using the medium type specifying unit by using the optical density information obtained by using the optical density information obtaining unit.

According to the sixth aspect, segmentation of the type of the medium specified by using the medium type specifying unit can be carried out. Moreover, setting of at least either one of the recording medium parameter and the abnormality detection parameter can be made for each segmented type of the medium.

A seventh aspect may be so constituted that, in the image recording apparatus in any one of the first aspect to the sixth aspect, the parameter setting unit sets the abnormality detection parameter in which actual recording position information for each recording element obtained by using the recording-position information obtaining unit and the recording-position chronological change information for each recording element calculated by using the recording-position chronological change information calculating unit are used.

According to the seventh aspect, setting of the abnormality detection threshold value in which the actual recording position for each recording element is reflected can be made.

An eighth aspect may be so constituted that, in the image recording apparatus in the seventh aspect, the parameter setting unit sets the abnormality detection parameter in which the average value of the recording-position chronological change information of the plurality of the recording elements calculated by using the recording-position chronological change information calculating unit or the median value of the recording-position chronological change information of the plurality of the recording elements calculated by using the recording-position chronological change information calculating unit are used.

According to the eighth aspect, setting of the abnormality detection threshold value in which the average value of the recording-position change information of the plurality of the recording elements or the median value of the recording-position change information of the plurality of the recording elements are used can be made.

A ninth aspect may be so constituted that, in the image recording apparatus in the seventh aspect or in the eighth aspect, the parameter setting unit sets $B+A\times\sigma_t$, and $B-A\times\sigma_t$ as the abnormality detection threshold value, where an arbitrary constant is A, an average value of the actual recording position for each recording element obtained by using the recording-position information obtaining unit is B, and a standard deviation for an error of the recording position for each recording element is $\sigma_t$.

According to the ninth aspect, setting of the abnormality detection threshold value in which the average value of the recording positions of the plurality of recording elements can be made.

A tenth aspect may be so constituted that, in the image recording apparatus of the ninth aspect, the parameter setting unit sets a value of the constant A relatively small when the setting of an image quality is a relatively high image quality and sets the value of the constant A relatively large when the setting of the image quality is a relatively low image quality, where the constant A is a positive number.

According to the tenth aspect, setting of the abnormality detection threshold value corresponding to the image quality can be made.

A parameter setting method of an image recording apparatus including a recording head includes a plurality of recording elements of an eleventh aspect includes: a recording-position information obtaining step of obtaining recording position information a plurality of times at an interval of an arbitrary period, the recording position information including information on an actual recording position in each of the plurality of recording elements included in the recording head; a recording-position chronological change information calculating step of calculating chronological change information of the recording position of each recording element by using the recording-position information of each recording element obtained in the recording position information obtaining step; a medium type specifying step of specifying a type of a medium by using the chronological change information of the recording position of each recording element calculated in the recording-position chronological change information calculating step; and a parameter setting step of automatically setting a recording parameter including at least any one of an output gradation value, an abnormal recording element correction coefficient, an uneven density correction coefficient, and a halftone processing rule in correspondence with the type of the medium specified in the medium type specifying step, automatically setting an abnormality detection parameter including at least any one of a measurement threshold value in recording-position information obtainment, an abnormality detection threshold value used for abnormality detection, and an abnormality detection procedure used for abnormality detection or automatically setting both the recording parameter and the abnormality detection parameter.

According to the eleventh aspect, an effect similar to that of the first aspect can be obtained.

In the eleventh aspect, a matter similar to the matters specified in the second aspect to the tenth aspect can be combined as appropriate. In that case, a constituent element in charge of processing or a function specified in the image recording apparatus can be grasped as a constituent element of the parameter setting method in charge of the processing or the function corresponding to that.

According to the present invention, since the type of the medium is specified by using the chronological change information of the recording position, the setting of the type of the medium is prevented from depending on the user. Moreover, since at least either one of the recording parameter corresponding to the specified type of the medium and the abnormality detection parameter is automatically set, improvement of usability can be expected.

Moreover, if the recording parameter corresponding to the type of the medium is automatically set, an unnecessary increase in the mask applied for correction is suppressed. Furthermore, insufficient correction and excessive correction caused by the setting of the mask is suppressed.

DETAILED DESCRIPTION OF THE EMBODIMENTS

Figure 1:
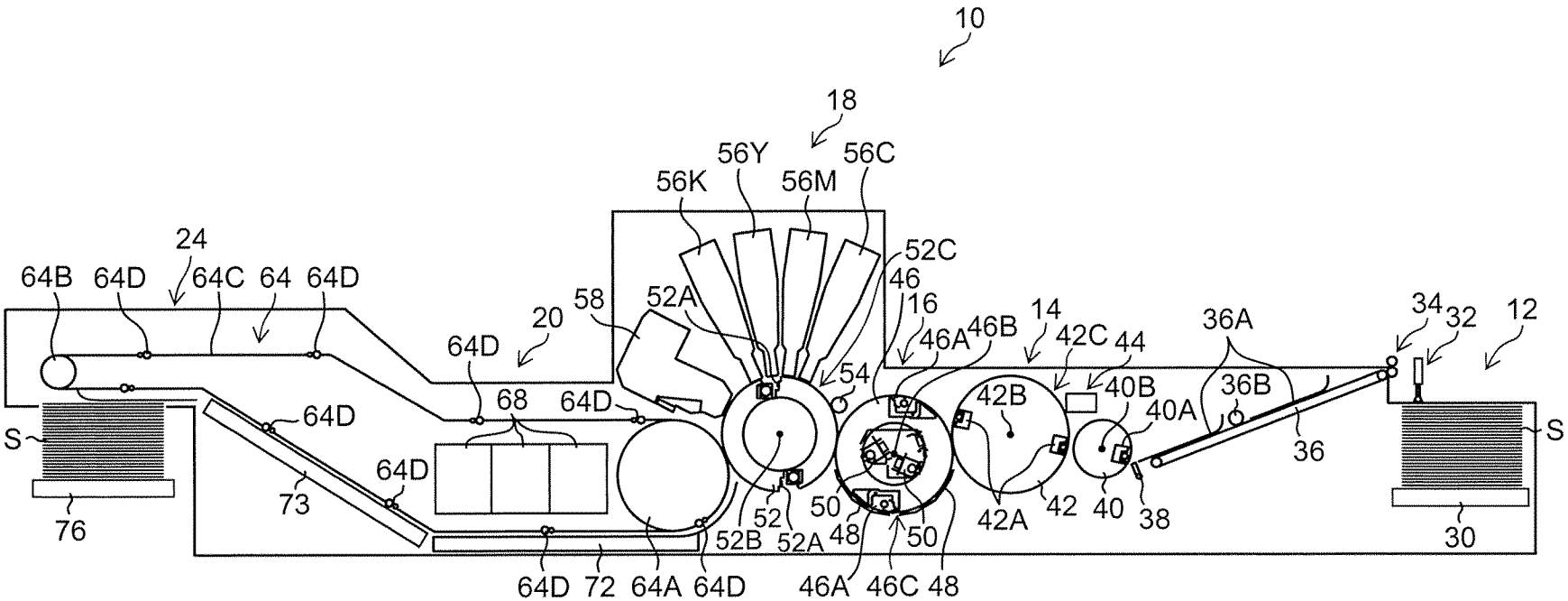
FIG. 1 is an entire constitutional diagram of an inkjet recording apparatus.

An embodiment of the present invention will be described below in detail in accordance with the attached drawings. In this Description, the same reference numerals are given to constitution having been already described, and explanation is omitted as appropriate.

[Entire Constitution of Liquid Ejection Device]

First, entire constitution of an image recording apparatus will be described. In this embodiment, as an image recording apparatus, an inkjet recording apparatus is exemplified. FIG. 1 is an entire constitutional diagram of the inkjet recording apparatus.

The inkjet recording apparatus 10 illustrated in FIG. 1 is an inkjet recording apparatus which draws an image in an inkjet method by using ink on a sheet of paper S. In this Description, the term of ink can be replaced by terms of liquid as appropriate.

The sheet S in this embodiment is a mode of a medium. Other modes of the medium include a sheet-shaped member such as resin or metal. The sheet-shaped member such as resin or metal may include those called a base material or a substrate.

The inkjet recording apparatus 10 includes a sheet feeding unit 12, a treatment liquid applying unit 14, a treatment liquid drying processing unit 16, a drawing unit 18, an ink drying processing unit 20, and a sheet ejecting unit 24. Each unit will be described below in detail.

<Sheet Feeding Unit>

The sheet feeding unit 12 includes a sheet feeding table 30, a sucker device 32, a sheet feeding roller pair 34, a feeder board 36, a front stopper 38, and a sheet feeding cylinder 40. The feeder board 36 includes a retainer 36A and a guide roller 36B.

The retainer 36A and the guide roller 36B are disposed on a conveyance surface on which the sheet S of the feeder board 36 is conveyed. The front stopper 38 is disposed between the feeder board 36 and the sheet feeding cylinder 40.

The sheet feeding cylinder 40 has a cylindrical shape with a direction in parallel with a rotating shaft 40B as a longitudinal direction. The sheet feeding cylinder 40 has a length exceeding an entire length of the sheet S in the longitudinal direction. The direction of the rotating shaft 40B of the sheet feeding cylinder 40 is a direction penetrating a paper surface of FIG. 1.

The term of the cylinder in this Description can be replaced by the term of a drum. The drum is a conveying member having a cylindrical shape and conveying the medium along an outer circumferential surface of the cylindrical shape by rotating the medium around a center shaft of the cylindrical shape with at least a part of the medium held.

Here, the term of parallel in this Description includes substantial parallel exerting the same working effect as the parallel, though two directions cross each other.

The term of orthogonal in this Description includes substantially orthogonal which exerts the same working effect as that of crossing at 90 degrees in case of crossing at an angle exceeding 90 degrees or that of crossing at an angle less than 90 degrees.

The term of the same in this Description includes substantially the same which can obtain the working effect similar to the same, though there is a difference in target constitution.

The sheet feeding cylinder 40 includes a gripper 40A. The gripper 40A includes a plurality of claws, a claw rest, and a gripper shaft. The plurality of claws, the claw rest, and the gripper shaft are not shown.

A plurality of claws of the gripper 40A is disposed along a direction in parallel with the rotating shaft 40B of the sheet feeding cylinder 40. Base end portions of the plurality of claws are supported by the gripper shaft, capable of swing. An arrangement interval of the plurality of claws and a length of an area in which the plurality of claws are disposed are determined in accordance with a size of the sheet S.

The claw rest is a member with a direction in parallel with the rotating shaft 40B of the sheet feeding cylinder 40 as a longitudinal direction. In the longitudinal direction of the sheet feeding cylinder 40, a length of the claw rest is set at the length or more of the area in which the plurality of claws is disposed. The claw rest is disposed at a position faced with tip end portions of the plurality of claws.

The sheet feeding unit 12 feeds sheets S loaded on the sheet feeding table 30 one by one to the treatment liquid applying unit 14. The sheets S loaded on the sheet feeding table 30 are lifted by the sucker device 32 one by one in order from the top and are fed to the sheet feeding roller pair 34.

The sheet S fed to the sheet feeding roller pair 34 is loaded on the feeder board 36 and is conveyed by the feeder board 36. The sheet S conveyed by the feeder board 36 is pressed onto a conveyance surface of the feeder board 36 by the retainer 36A and the guide roller 36B and its irregularity is corrected.

The sheet S conveyed by the feeder board 36 has its leading edge brought into contact with the front stopper 38, whereby inclination is corrected. The sheet S conveyed by the feeder board 36 is delivered to the sheet feeding cylinder 40.

The sheet S having been delivered to the sheet feeding cylinder 40 has its leading edge portion gripped by the gripper 40A of the sheet feeding cylinder 40. When the sheet feeding cylinder 40 is rotated, the sheet S is conveyed along the outer circumferential surface of the sheet feeding cylinder 40. The sheet S conveyed by the sheet feeding cylinder 40 is delivered to the treatment liquid applying unit 14.

<Treatment Liquid Applying Unit>

The treatment liquid applying unit 14 includes a treatment liquid cylinder 42 and a treatment liquid applying device 44. The treatment liquid cylinder 42 includes a gripper 42A. To the gripper 42A, constitution similar to that of the gripper 40A of the sheet feeding cylinder 40 can be applied.

The treatment liquid cylinder 42 illustrated in FIG. 1 has a diameter twice of a diameter of the sheet feeding cylinder 40. In the treatment liquid cylinder 42, the grippers 42A are disposed at two spots. Arrangement positions of the grippers 42A at the two spots are positions shifted by a half circle on an outer circumferential surface 42C of the treatment liquid cylinder 42.

The treatment liquid cylinder 42 has constitution for fixing the sheet S on the outer circumferential surface 42C on which the sheet S is supported. As an example of the constitution for fixing the sheet S on the outer circumferential surface 42C of the treatment liquid cylinder 42, constitution in which a plurality of suction holes is provided in the outer circumferential surface 42C of the treatment liquid cylinder 42 so as to cause a negative pressure to act on the plurality of suction holes is cited.

To the treatment liquid cylinder 42, the constitution similar to that of the sheet feeding cylinder 40 except the above can be applied. Reference numeral 42B designates a rotating shaft of the treatment liquid cylinder 42.

To the treatment liquid applying device 44, a roller application method can be applied. As the roller application type treatment liquid applying device 44, constitution including a treatment liquid vessel, a measuring roller, and an application roller can be employed.

The treatment liquid vessel stores a treatment liquid supplied from a treatment liquid tank through a treatment liquid supply system. The measuring roller measures the treatment liquid stored in the treatment liquid vessel. The measuring roller transfers the measured treatment liquid to the application roller. The application roller applies the treatment liquid on the sheet S.

The constitution of the treatment liquid applying device 44 described here is only an example, and other methods may be applied to the treatment liquid applying device 44. Moreover, another constitution may be applied to the treatment liquid applying device 44.

As an example of another method of the treatment liquid applying device 44, application using a blade, ejection by an inkjet method or spraying by a spraying method can be cited.

By rotating the treatment liquid cylinder 42 in a state where the leading edge of the sheet S is gripped by the gripper 42A, the sheet S is conveyed along the outer circumferential surface of the treatment liquid cylinder 42. To the sheet S conveyed along the outer circumferential surface of the treatment liquid cylinder 42, the treatment liquid is applied by the treatment liquid applying device 44. The sheet S to which the treatment liquid has been applied is fed to the treatment liquid drying processing unit 16.

The treatment liquid applied to the sheet S has a function of coagulating a color material in the ink deposited by the drawing unit 18 on the rear part to the sheet S or a function of insolubilizing the color material in the ink. By applying the treatment liquid to the sheet S and by ejecting the ink, high-quality image formation can be carried out without landing interference or the like even if a general-purpose sheet is used.

The term of ejection in this Description can be also read as droplet ejection, image formation or image recording as appropriate.

The sheet S to which the treatment liquid has been applied by the treatment liquid applying unit 14 is delivered to the treatment liquid drying processing unit 16.

<Treatment Liquid Drying Processing Unit>

The treatment liquid drying processing unit 16 includes a treatment liquid drying processing cylinder 46, a sheet conveyance guide 48, and the treatment liquid drying processing unit 50. The treatment liquid drying processing cylinder 46 includes a gripper 46A. To the gripper 46A, constitution similar to that of the gripper 40A of the sheet feeding cylinder 40 can be applied.

The treatment liquid drying processing cylinder 46 illustrated in FIG. 1 has a diameter twice of a diameter of the sheet feeding cylinder 40. The treatment liquid drying processing cylinder 46 has the grippers 46A disposed at two spots. Arrangement positions of the grippers 46A at the two spots are positions shifted by a half circle on an outer circumferential surface 46C of the treatment liquid drying processing cylinder 46.

To the constitution of the treatment liquid drying processing cylinder 46 other than the above, the constitution similar to that of the sheet feeding cylinder 40 can be applied. Reference numeral 46B designates a rotating shaft of the treatment liquid drying processing cylinder 46.

The sheet conveyance guide 48 is disposed at a position faced with the outer circumferential surface 46C of the treatment liquid drying processing cylinder 46. The sheet conveyance guide 48 is disposed on a lower side of the treatment liquid drying processing cylinder 46.

The lower side in this Description is a side of a gravity direction. An upper sided is a side opposite to the gravity direction.

The treatment liquid drying processing unit 50 is disposed inside of the treatment liquid drying processing cylinder 46. The treatment liquid drying processing unit 50 includes an air blowing portion for blowing air toward an outside of the treatment liquid drying processing cylinder 46 and a heating portion for heating the air. For convenience of the illustration, reference numerals of the air blowing portion and the heating portion are omitted.

The sheet S delivered from the treatment liquid applying unit 14 to the treatment liquid drying processing unit 16 has its leading edge gripped by the gripper 46A of the treatment liquid drying processing cylinder 46.

The sheet S has a surface on a side opposite to a surface on which the treatment liquid is applied supported by the sheet conveyance guide 48 in a state where the surface on which the treatment liquid is applied is directed toward the outer circumferential surface 46C of the treatment liquid drying processing cylinder 46. By rotating the treatment liquid drying processing cylinder 46, the sheet S is conveyed along the outer circumferential surface 46C of the treatment liquid drying processing cylinder 46.

The sheet S conveyed by the treatment liquid drying processing cylinder 46 and supported by the sheet conveyance guide 48 is subjected to drying processing by heated air blown from the treatment liquid drying processing unit 50.

When the drying processing is applied to the sheet S, a solvent component in the treatment liquid applied to the sheet S is removed, and a treatment liquid layer is formed on the surface of the sheet S to which the treatment liquid is applied. The sheet S to which the drying processing is applied by the treatment liquid drying processing unit 16 is delivered to the drawing unit 18.

<Drawing Unit>

The drawing unit 18 includes a drawing cylinder 52, a sheet pressing roller 54, a liquid ejection head 56C, a liquid ejection head 56M, a liquid ejection head 56Y, a liquid ejection head 56K, and an inline sensor 58. The drawing cylinder 52 includes a gripper 52A.

The gripper 52A is disposed inside of a recess portion provided in the outer circumferential surface 52C of the drawing cylinder 52. To constitution other than arrangement of the gripper 52A, the constitution similar to the gripper 40A of the sheet feeding cylinder 40 can be applied.

In the drawing cylinder 52, the grippers 52A are disposed at two spots similarly to the treatment liquid drying processing cylinder 46. To the arrangement of the grippers 52A at the two spots, the arrangement similar to the treatment liquid drying processing cylinder 46 can be applied.

In the drawing cylinder 52, a suction hole is disposed in the outer circumferential surface 52C by which the sheet S is supported. The suction hole is disposed in a medium support area where the sheet S is suctioned and supported. Illustration of the suction hole and the medium support area is omitted.

To the constitution of the drawing cylinder 52 other than the above, the constitution similar to that of the sheet feeding cylinder 40 can be applied. Reference character 52B designates a rotating shaft of the drawing cylinder 52.

The sheet pressing roller 54 has a cylindrical shape. A longitudinal direction of the sheet pressing roller 54 is a direction in parallel with the rotating shaft 52B of the drawing cylinder 52. The sheet pressing roller 54 has a length exceeding the entire length of the sheet S in the longitudinal direction.

The sheet pressing roller 54 is disposed on a downstream side of a delivery position of the sheet S and on an upstream side of the liquid ejection head 56C with respect to the conveyance direction of the sheet S in the drawing cylinder 52. In the following description, the conveyance direction of the sheet S is described as a sheet conveyance direction in some cases. The sheet conveyance direction corresponds to a medium conveyance direction.

The liquid ejection head 56C, the liquid ejection head 56M, the liquid ejection head 56Y, and the liquid ejection head 56K includes nozzle portions which eject a liquid by an inkjet method, respectively.

In FIG. 1, illustration of the nozzle portion is omitted. The nozzle portion is illustrated with reference numeral 281 in FIG. 6. The nozzle portion in this embodiment is an aspect of a recording element.

Here, alphabets given to the reference numerals of the liquid ejection head designate colors. Reference character C designates cyan. Reference character M designates magenta. Reference character Y designates yellow. Reference character K designates black.

The liquid ejection head 56C, the liquid ejection head 56M, the liquid ejection head 56Y, and the liquid ejection head 56K are disposed on the upper side of the drawing cylinder 52. The liquid ejection head 56C, the liquid ejection head 56M, the liquid ejection head 56Y, and the liquid ejection head 56K are disposed in order of the liquid ejection head 56C, the liquid ejection head 56M, the liquid ejection head 56Y, and the liquid ejection head 56K along the sheet conveyance direction from the upstream side in the sheet conveyance direction.

The inline sensor 58 is disposed on the downstream side of the liquid ejection head 56K with respect to the sheet conveyance direction. The inline sensor 58 includes an imaging element, a peripheral circuit of the imaging element, and a light source.

As the imaging element, a solid imaging element such as a CCD image sensor and a CMOS image sensor can be applied. Illustration of the imaging element, the peripheral circuit of the imaging element, and the light source is omitted. The term CCD is an abbreviation of Charge Coupled Device. The term CMOS is an abbreviation of Complementary Metal-Oxide Semiconductor.

The peripheral circuit of the imaging element includes a processing circuit of an output signal of the imaging element. As the processing circuit, a filter circuit for removing a noise component from the output signal of the imaging element, an amplification circuit or a waveform shaping circuit or the like is cited. Illustration of the filter circuit, the amplification circuit or the waveform shaping circuit is omitted.

The light source is disposed at a position capable of projecting illumination light to a reading target of the inline sensor. As the light source, an LED or a lamp can be applied. The term LED is an abbreviation of a light emitting diode.

The sheet S delivered from the treatment liquid drying processing unit 16 to the drawing unit 18 has its leading edge gripped by the gripper 52A of the drawing cylinder 52. The sheet S having its leading edge gripped by the gripper 52A of the drawing cylinder 52 is conveyed along the outer circumferential surface 52C of the drawing cylinder 52 by rotation of the drawing cylinder 52.

When the sheet S passes under the sheet pressing roller 54, the sheet S is pressed onto the outer circumferential surface 52C of the drawing cylinder 52. On the sheet S having passed under the sheet pressing roller 54, immediately below the liquid ejection head 56C, the liquid ejection head 56M, the liquid ejection head 56Y, and the liquid ejection head 56K, an image is formed by color ink ejected from each of the liquid ejection head 56C, the liquid ejection head 56M, the liquid ejection head 56Y, and the liquid ejection head 56K.

The sheet S on which the image is formed by the liquid ejection head 56C, the liquid ejection head 56M, the liquid ejection head 56Y, and the liquid ejection head 56K has its image read out by the inline sensor 58 in a reading area of the inline sensor 58.

The sheet S from which the image is read out by the inline sensor 58 is delivered from the drawing unit 18 to the ink drying processing unit 20. Presence of ejection abnormality may be determined from a result of image reading by the inline sensor 58.

<Ink Drying Processing Unit>

The ink drying processing unit 20 includes a chain gripper 64, an ink drying processing unit 68, and a guide plate 72. The chain gripper 64 includes a first sprocket 64A, a second sprocket 64B, a chain 64C, and a plurality of grippers 64D.

The chain gripper 64 has a structure in which a pair of endless chains 64C is wound around a pair of the first sprockets 64A and second sprockets 64B. FIG. 1 illustrates only one of the pair of first sprockets 64A and second sprockets 64B and the pair of chains 64C.

The chain gripper 64 has a structure in which a plurality of the grippers 64D is disposed between the pair of chains 64C. Moreover, the chain gripper 64 has a structure in which a plurality of the grippers 64D is disposed at a plurality of positions in the sheet conveyance direction. FIG. 1 illustrates only one gripper 64D in the plurality of grippers 64D disposed between the pair of chains 64C.

The chain gripper 64 illustrated in FIG. 1 includes a horizontal conveyance area where the sheet S is conveyed along a horizontal direction and an inclined conveyance area where the sheet S is conveyed to a diagonally upper direction.

The ink drying processing unit 68 is disposed on a conveyance path of the sheet S in the chain gripper 64. As a constitution example of the ink drying processing unit 68, constitution including a heat source such as a halogen heater, an infrared heater and the like is cited. As another constitution example of the ink drying processing unit 68, constitution including a fan which blows air heated by the heat source to the sheet S is cited. The ink drying processing unit 68 may be constituted including the heat source and the fan.

Detailed illustration of the guide plate 72 is omitted, but a plate-shaped member may be applied for the guide plate 72. The guide plate 72 has a length exceeding the entire length of the sheet S in a direction orthogonal to the sheet conveyance direction.

The guide plate 72 is disposed along the conveyance path in the horizontal conveyance area of the sheet S by the chain gripper 64. The guide plate 72 is disposed on the lower side of the conveyance path of the sheet S by the chain gripper 64. The guide plate 72 has a length corresponding to a length of a processing area of the ink drying processing unit 68 with respect to the sheet conveyance direction.

The length corresponding to the length of the processing area of the ink drying processing unit 68 is a length of the guide plate 72 capable of supporting the sheet S by the guide plate 72 in processing of the ink drying processing unit 68.

For example, a mode in which the length of the processing area of the ink drying processing unit 68 and the length of the guide plate 72 are made the same with respect to the sheet conveyance direction is cited. The guide plate 72 may include a function of suctioning and supporting the sheet S.

The sheet S having been delivered from the drawing unit 18 to the ink drying processing unit 20 has its leading edge gripped by the gripper 64D. By rotating at least either one of the first sprockets 64A, and the second sprockets 64B clockwise in FIG. 1 so as to make the chain 64C run, the sheet S is conveyed along a running path of the chain 64C.

When the sheet S passes the processing area of the ink drying processing unit 68, the ink drying processing is applied to the sheet S by the ink drying processing unit 68.

The sheet S to which the ink drying processing was applied by the ink drying processing unit 68 is conveyed by the chain gripper 64 and sent to the sheet ejecting unit 24.

The chain gripper 64 illustrated in FIG. 1 conveys the sheet S to a diagonally upper left direction in FIG. 1 on the downstream side of the ink drying processing unit 68 in the sheet conveyance direction. In the conveyance path of the inclined conveyance area which conveys the sheet S in the diagonally upper left direction in FIG. 1, a guide plate 73 is disposed.

To the guide plate 73, a member similar to the guide plate 72 may be applied. Description on a structure and a function of the guide plate 73 is omitted.

<Sheet Ejecting Unit>

The sheet ejecting unit 24 includes a sheet ejecting table 76. For conveyance of the sheet S in the sheet ejecting unit 24, the chain gripper 64 is applied.

The sheet ejecting table 76 is disposed on the lower side of the conveyance path of the sheet S by the chain gripper 64. The sheet ejecting table 76 can have constitution including an elevating mechanism, not shown. The sheet ejecting table 76 can keep a height of the sheet S located at an uppermost position constant by being elevated in accordance with an increase/decrease of the loaded sheets S.

The sheet ejecting unit 24 recovers the sheet S to which a series of processing for image formation has been applied. When the sheet S reaches a position of the sheet ejecting table 76, the gripper 64D releases gripping of the sheet S. The sheet S is loaded on the sheet ejecting table 76.

In FIG. 1, the inkjet recording apparatus 10 including the treatment liquid applying unit 14 and the treatment liquid drying processing unit 16 is shown, but there can be a mode in which the treatment liquid applying unit 14 and the treatment liquid drying processing unit 16 are omitted.

Moreover, in FIG. 1, the chain gripper 64 is exemplified as the constitution which conveys the sheet S after drawing, but for the constitution which conveys the sheet S after the drawing, another constitution such as belt conveyance or a conveying drum conveyance may be applied.

[Description of Control System]

Figure 2:
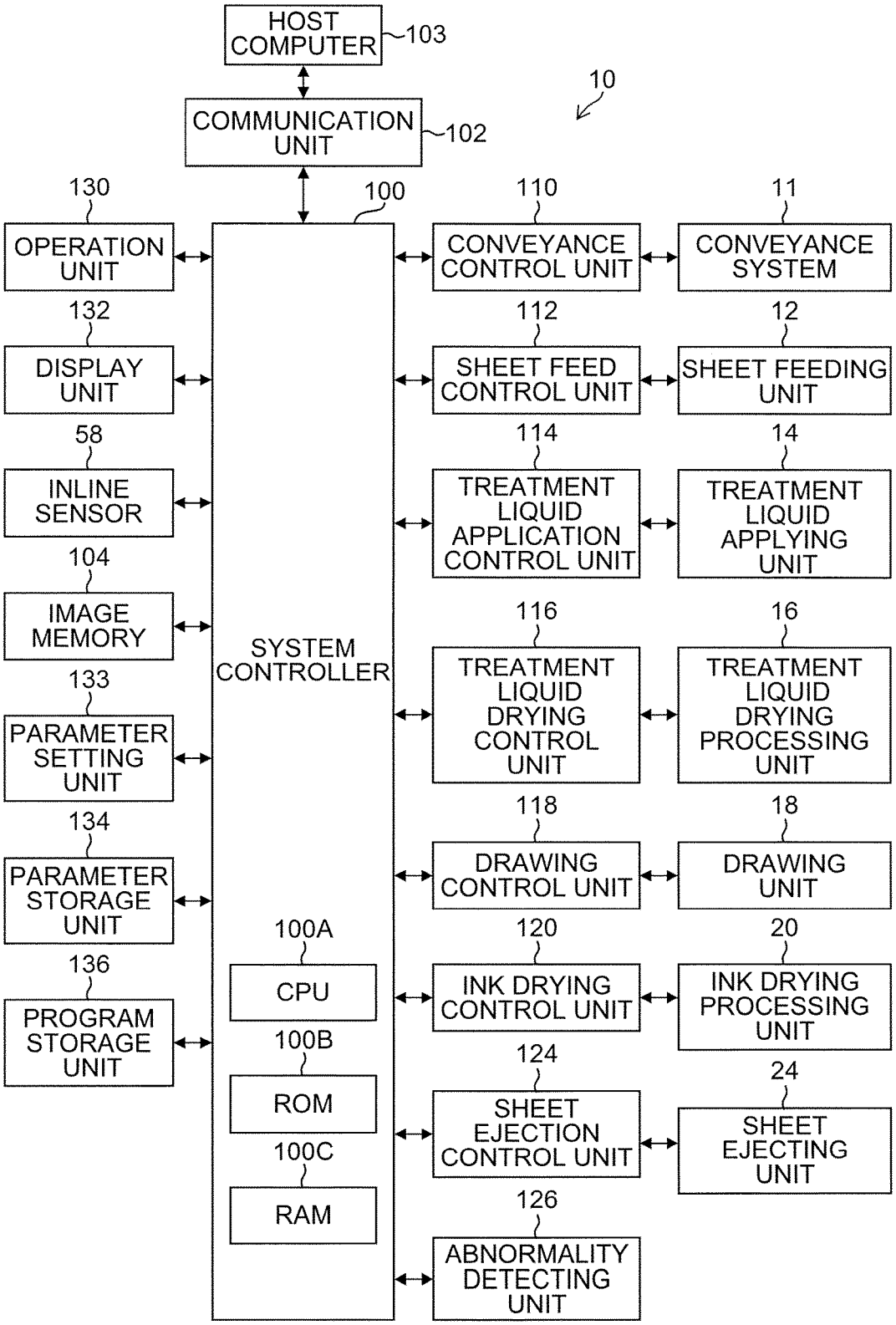
FIG. 2 is a block diagram illustrating an outline configuration of a control system.

FIG. 2 is a block diagram illustrating outline configuration of the control system. As illustrated in FIG. 2, the inkjet recording apparatus 10 includes a system controller 100. The system controller 100 includes a CPU 100A, a ROM 100B and a RAM 100C.

The ROM 100B and the RAM 100C illustrated in FIG. 2 may be provided outside of the CPU. The term CPU is an abbreviation of a Central Processing Unit. The term ROM is an abbreviation of Read Only Memory. The term RAM is an abbreviation of Random Access Memory.

The system controller 100 functions as an entire control unit which integrally controls each unit of the inkjet recording apparatus 10. Moreover, the system controller 100 functions as a calculating unit which carries out various calculation processing.

Furthermore, the system controller 100 functions as a memory controller which controls reading of data and writing of data in memory such as the ROM 100B and the RAM 100C.

The inkjet recording apparatus 10 includes a communication unit 102, an image memory 104, a conveyance control unit 110, a sheet feed control unit 112, a treatment liquid application control unit 114, a treatment liquid drying control unit 116, a drawing control unit 118, an ink drying control unit 120, and a sheet feed control unit 124.

The communication unit 102 includes a communication interface, not shown. The communication unit 102 is capable of transmission/reception of data with a host computer 103 connected to the communication interface.

The image memory 104 functions as a temporary storage unit for various types of data including image data. The image memory 104 reads/writes data through the system controller 100. The image data taken in from the host computer 103 through the communication unit 102 is stored in the image memory 104 once.

The conveyance control unit 110 controls an operation of a conveyance system 11 of the sheet S in the inkjet recording apparatus 10. The conveyance system 11 illustrated in FIG. 2 includes the treatment liquid cylinder 42, the treatment liquid drying processing cylinder 46, the drawing cylinder 52, and the chain gripper 64 illustrated in FIG. 1.

The sheet feed control unit 112 illustrated in FIG. 2 operates the sheet feeding unit 12 in accordance with an instruction from the system controller 100. The sheet feed control unit 112 controls a supply start operation of the sheet S and a supply stop operation of the sheet S and the like.

The treatment liquid application control unit 114 operates the treatment liquid applying unit 14 in accordance with an instruction from the system controller 100. The treatment liquid application control unit 114 controls an application amount of the treatment liquid and application timing and the like.

The treatment liquid drying control unit 116 operates the treatment liquid drying processing unit 16 in accordance with an instruction from the system controller 100. The treatment liquid drying control unit 116 controls a drying temperature, a flowrate of a drying gas, and injection timing of the drying gas.

The drawing control unit 118 controls an operation of the drawing unit 18 in accordance with an instruction from the system controller 100. That is, the drawing control unit 118 controls ink injection of the liquid ejection head 56C, the liquid ejection head 56M, the liquid ejection head 56Y, and the liquid ejection head 56K illustrated in FIG. 1.

The drawing control unit 118 includes an image processing unit, not shown. The image processing unit forms dot data from input image data. The image processing unit includes a color separation processing unit, a color conversion processing unit, a correction processing unit, and a halftone processing unit, not shown.

In the color separation processing unit, color separation processing is applied to the input image data. For example, if the input image data is expressed by RGB, the input image data is separated to data for each color of R, G, and B. Here, R indicates red. G indicates green. B indicates blue.

In the color conversion processing unit, the image data for each of the colors separated to R, G, and B is converted to C, M, Y, and K corresponding to ink colors. Here, C indicates cyan. M indicates magenta. Y indicates yellow. K indicates black.

The correction processing unit applies correction processing to the image data for each color converted to C, M, Y, and K. As examples of the correction processing, gamma correction processing, density unevenness correction processing or abnormal recording element correction processing and the like is cited.

In the halftone processing unit, image data expressed by multi-gradation number such as 0 to 255, for example, is converted to dot data expressed by multiple values such as a binary or a ternary value or more less than the gradation number of the input image data.

In the halftone processing unit, a halftone processing rule determined in advance is applied. As examples of the halftone processing rule, a dither method or an error diffusion method and the like are cited. The halftone processing rule may be changed in accordance with an image recording condition or contents of the image data and the like.

The drawing control unit 118 includes a waveform generating portion, a waveform storage portion, and a driving circuit, not shown. The waveform generating portion generates a waveform of a driving voltage. The waveform storage portion stores the waveform of the driving voltage. The driving circuit generates a driving voltage having the driving waveform according to the dot data. The driving circuit supplies the driving voltage to the liquid ejection head 56C, the liquid ejection head 56M, the liquid ejection head 56Y, and the liquid ejection head 56K illustrated in FIG. 1.

That is, on the basis of the dot data generated through the processing by the image processing unit, ejection timing and an ink ejection amount at each pixel position are determined, and a control signal determining the driving voltage according to the ejection timing and the ink ejection amount at each pixel position and the ejection timing of each pixel is generated, this driving voltage is supplied to the liquid ejection head and a dot is recorded by the ink ejected from the liquid ejection head.

The ink drying control unit 120 operates the ink drying processing unit 20 in accordance with an instruction from the system controller 100. The ink drying control unit 120 controls a drying gas temperature, an air amount of the drying gas or injection timing of the drying gas and the like.

A sheet ejection control unit 124 operates the sheet ejecting unit 24 in accordance with an instruction from the system controller 100. The sheet ejection control unit 124 controls an operation of the elevating mechanism in accordance with an increase/decrease of the sheets S when the sheet ejecting table 76 illustrated in FIG. 1 includes the elevating mechanism.

The inkjet recording apparatus 10 illustrated in FIG. 2 includes an abnormality detecting unit 126. The abnormality detecting unit 126 detects ejection abnormality of each of the liquid ejection head 56C, the liquid ejection head 56M, the liquid ejection head 56Y, and the liquid ejection head 56K illustrated in FIG. 1.

The ejection abnormality includes non-ejection that the ink cannot be ejected, ejection amount abnormality that the ink ejection amount is outside of a normal range and deposition position abnormality that a landing position of an ink droplet is outside of the normal range determined in advance, though the ink can be ejected. The ejection position abnormality may be regarded as ejection direction abnormality.

The abnormality detection using the abnormality detecting unit 126 illustrated in FIG. 2 is executed in accordance with the following procedure. First, a test pattern is formed on a medium by using the liquid ejection head 56C, the liquid ejection head 56M, the liquid ejection head 56Y, and the liquid ejection head 56K illustrated in FIG. 1.

Subsequently, the test pattern formed on the medium is read by using the inline sensor 58. An output signal of the inline sensor 58 indicating a reading result of the test pattern is obtained by using the abnormality detecting unit 126.

In the abnormality detecting unit 126, the output signal of the inline sensor 58 is analyzed, and an error of the landing position for each nozzle portion of each of the liquid ejection head 56C, the liquid ejection head 56M, the liquid ejection head 56Y, and the liquid ejection head 56K, density of the test pattern for each nozzle portion and the like are derived. An index derived by the analysis of the output signal of the inline sensor 58 is compared with a threshold value set in advance, and presence of abnormality is determined. The abnormality detecting unit 126 may be configured as a part of the drawing control unit 118.

The inkjet recording apparatus 10 illustrated in FIG. 2 includes an operation unit 130, a display unit 132, a parameter setting unit 133, a parameter storage unit 134, and a program storage unit 136.

The operation unit 130 includes an operating member such as an operation button, a keyboard or a touch panel and the like. The operation unit 130 may include a plurality of types of the operating members. Illustration of the operating member is omitted.

Information input through the operation unit 130 is sent to the system controller 100. The system controller 100 causes various processing to be executed in accordance with the information sent out from the operation unit 130.

The display unit 132 includes a display device such as a liquid crystal panel or the like and a display driver. Illustration of the display device and the display driver is omitted. The display unit 132 causes various types of setting information of the apparatus or various types of information such as abnormality information to be displayed on the display device in accordance with an instruction from the system controller 100.

The parameter setting unit 133 sets various parameters used for the inkjet recording apparatus 10. Details of the parameter setting unit 133 will be described later.

The parameter storage unit 134 stores various parameters used for the inkjet recording apparatus 10. The various parameters stored in the parameter storage unit 134 are read out through the system controller 100 and set in each portion of the apparatus.

The program storage unit 136 stores programs used for each portion of the inkjet recording apparatus 10. The various programs stored in the program storage unit 136 are read out through the system controller 100 and executed in each portion of the apparatus.

FIG. 2 lists each portion for each function. Each portion illustrated in FIG. 2 can be integrated, separated, shared or omitted as appropriate. Moreover, each portion illustrated in FIG. 2 can be configured by combining hardware and software as appropriate.

[Structure of Liquid Ejection Head]

Subsequently, a structure of the liquid ejection head illustrated in FIG. 1 will be described in detail. The liquid ejection head in this embodiment is a mode of the recording head.

[Entire Structure]

Figure 3:
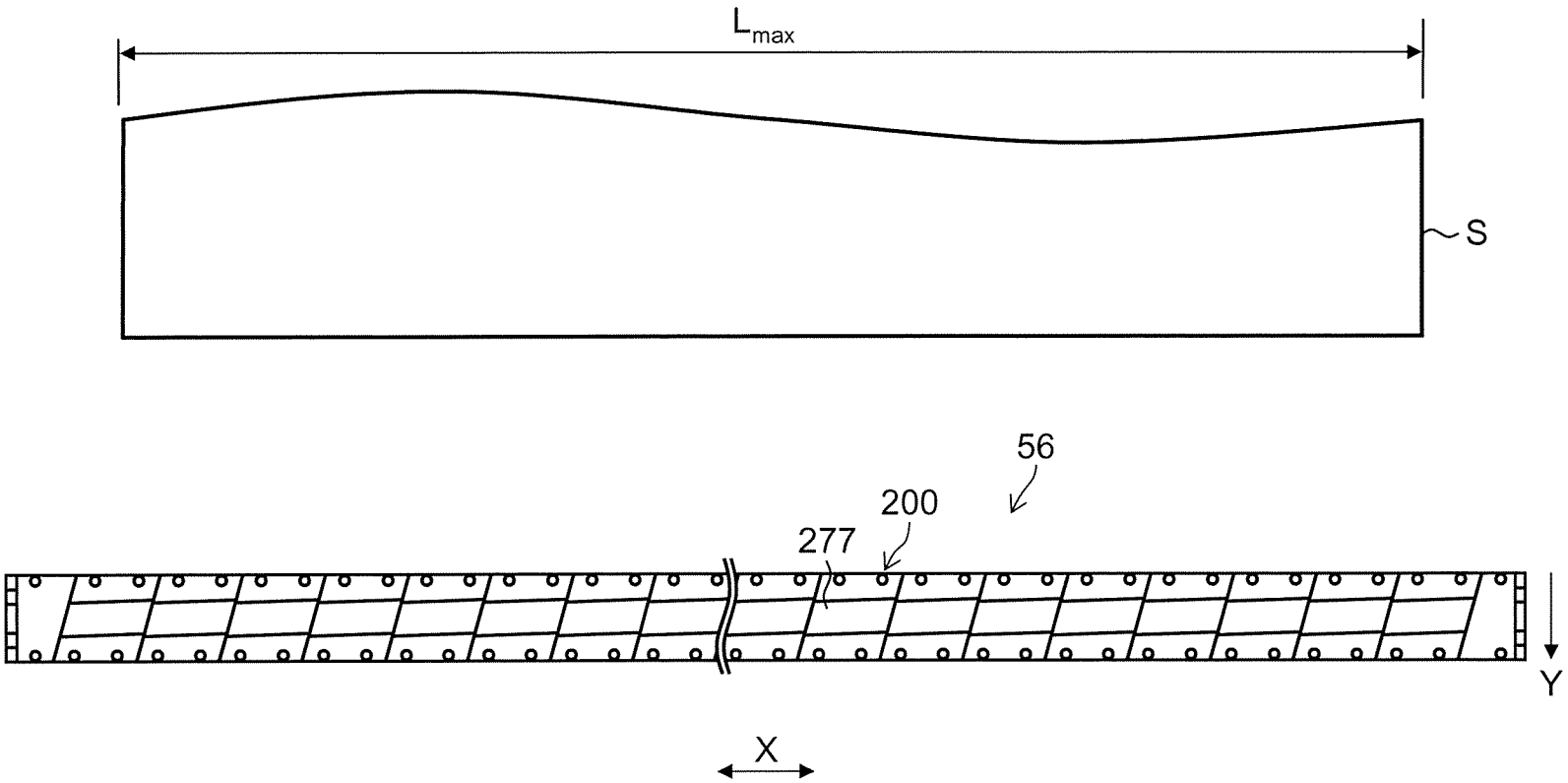
FIG. 3 is a perspective plan view illustrating a structure example of a liquid ejection head.

FIG. 3 is a perspective plan view illustrating a structure example of the liquid ejection head. The same structure can be applied to the liquid ejection head 56C which ejects the ink in cyan, the liquid ejection head 56M which ejects the ink in magenta, the liquid ejection head 56Y which ejects the ink in yellow, and the liquid ejection head 56K which ejects the ink in black illustrated in FIG. 1.

When the liquid ejection head 56C, the liquid ejection head 56M, the liquid ejection head 56Y, and the liquid ejection head 56K do not have to be discriminated, it is assumed that reference numeral 56 is used to indicate the liquid ejection head.

Figure 6:
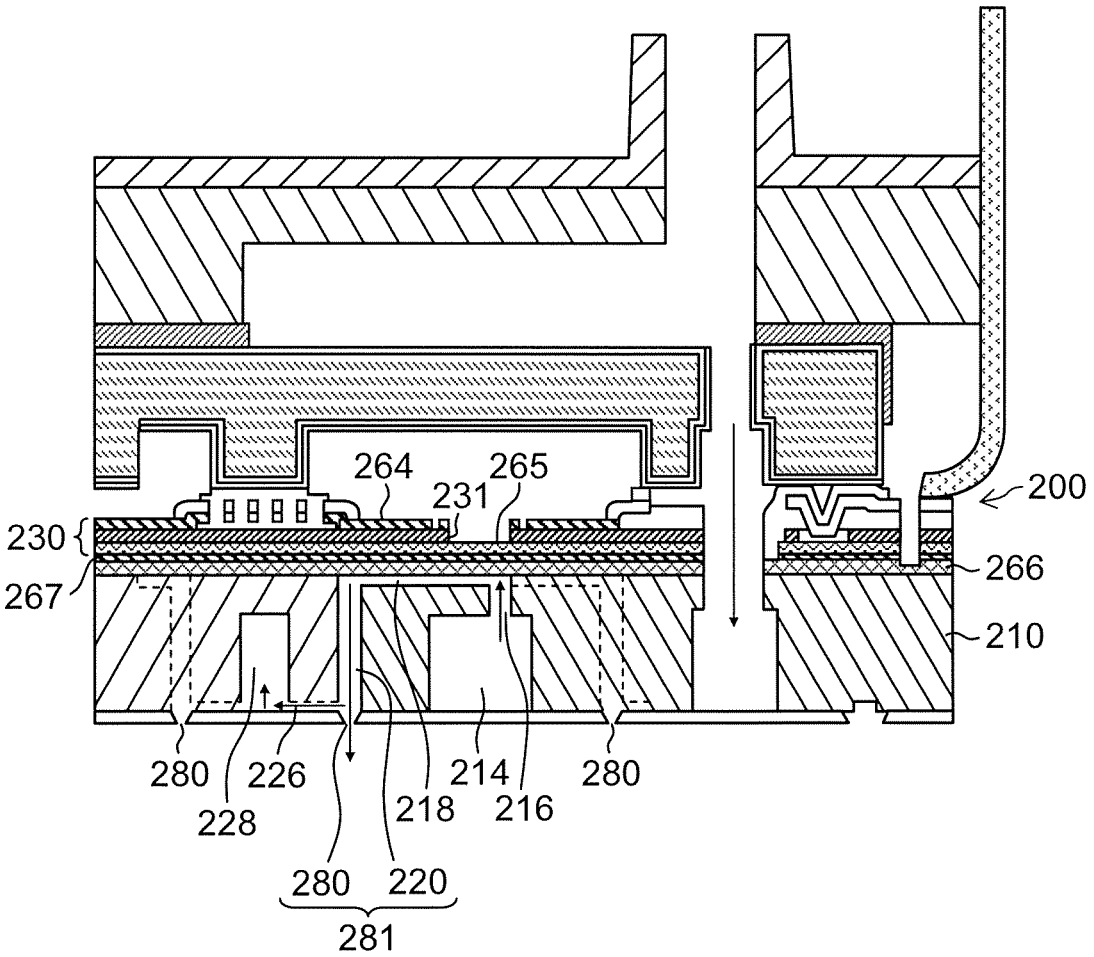
FIG. 6 is a sectional view illustrating an internal structure of the head module.

As illustrated in FIG. 3, the liquid ejection head 56 is a line-type head. The line-type head has a structure in which a plurality of nozzle portions is disposed over a length exceeding an entire width $L_{max}$ of the sheet S with respect to a direction orthogonal to the sheet conveyance direction. In FIG. 3, illustration of the nozzle portion is omitted. The nozzle portion is illustrated in FIG. 6 by using reference numeral 281.

A direction indicated by using reference character X in FIG. 3 designates a direction orthogonal to the sheet conveyance direction. A direction indicated by using reference character Y designates the sheet conveyance direction in FIG. 3. Hereinafter, the direction orthogonal to the sheet conveyance direction is described as a sheet width direction or an X-direction in some cases. Moreover, the sheet conveyance direction is described as a Y-direction in some cases.

The liquid ejection head 56 illustrated in FIG. 3 includes a plurality of head modules 200. The plurality of head modules 200 is disposed in a single row along the sheet width direction.

To the plurality of head modules 200, the same constitution may be applied. Moreover, the head module 200 may have a structure which can function as a liquid ejection head as a single body.

FIG. 3 illustrates the liquid ejection head 56 in which the plurality of head modules 200 is disposed in a single row along the sheet width direction, but the plurality of head modules 200 may be disposed in two rows by shifting a phase in the sheet conveyance direction.

On an ejection surface 277 of the head module 200 constituting the liquid ejection head 56, a plurality of nozzle openings is disposed. In FIG. 3, illustration of the nozzle opening is omitted. The nozzle opening is illustrated with reference numeral 280 in FIG. 5.

In this embodiment, the full-line type liquid ejection head 56 is exemplified, but a serial type may be applied in which a short-length serial-type liquid ejection head shorter than the entire width $L_{max}$ of the sheet S is made to traverse in the sheet width direction so as to carry out a single session of image formation in the sheet width direction, and when the single session of image formation in the sheet width direction is finished, the sheet S is conveyed for a certain amount in the sheet conveyance direction, and the image formation in the sheet width direction is carried out for the subsequent area, and this operation is repeated so as to carry out the image formation on the whole surface of the sheet.

<Structure Example of Head Module>

Subsequently, the head module will be described in detail.

Figure 4:
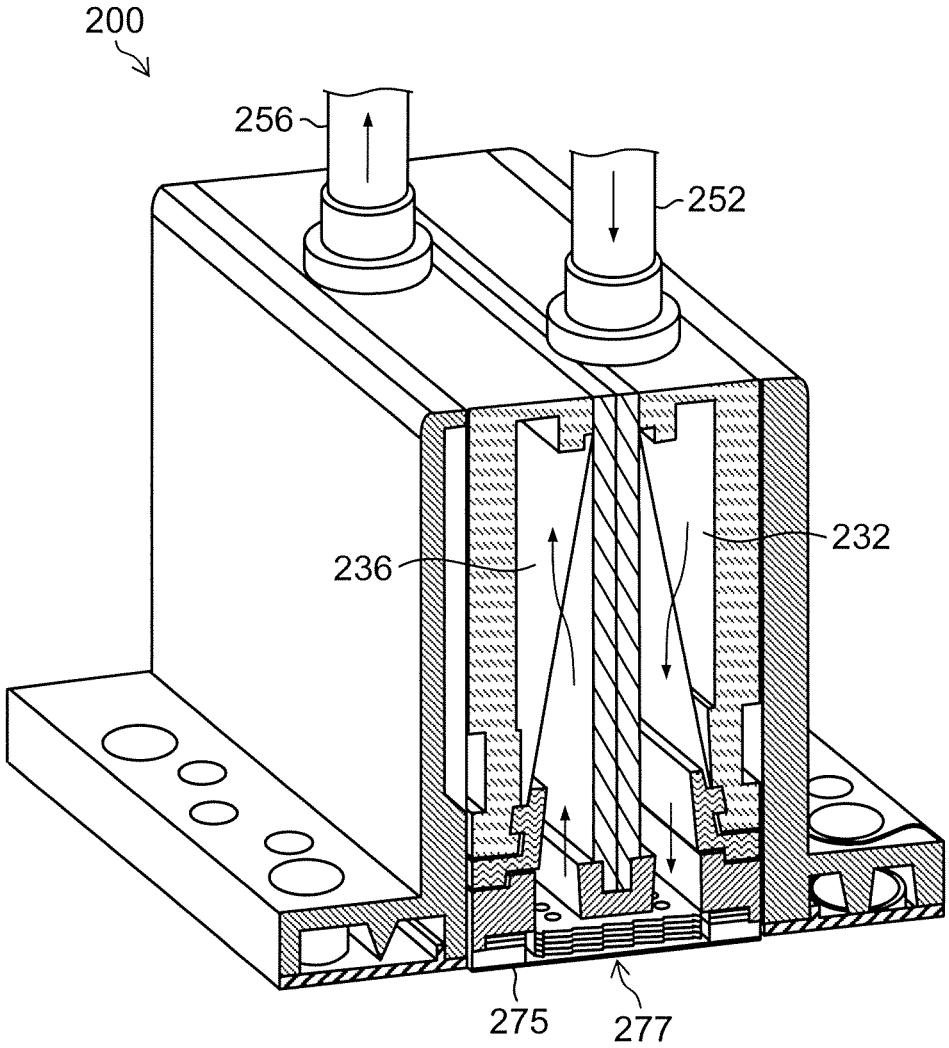
FIG. 4 is a perspective view of a head module and a view including a partial sectional view.
Figure 5:
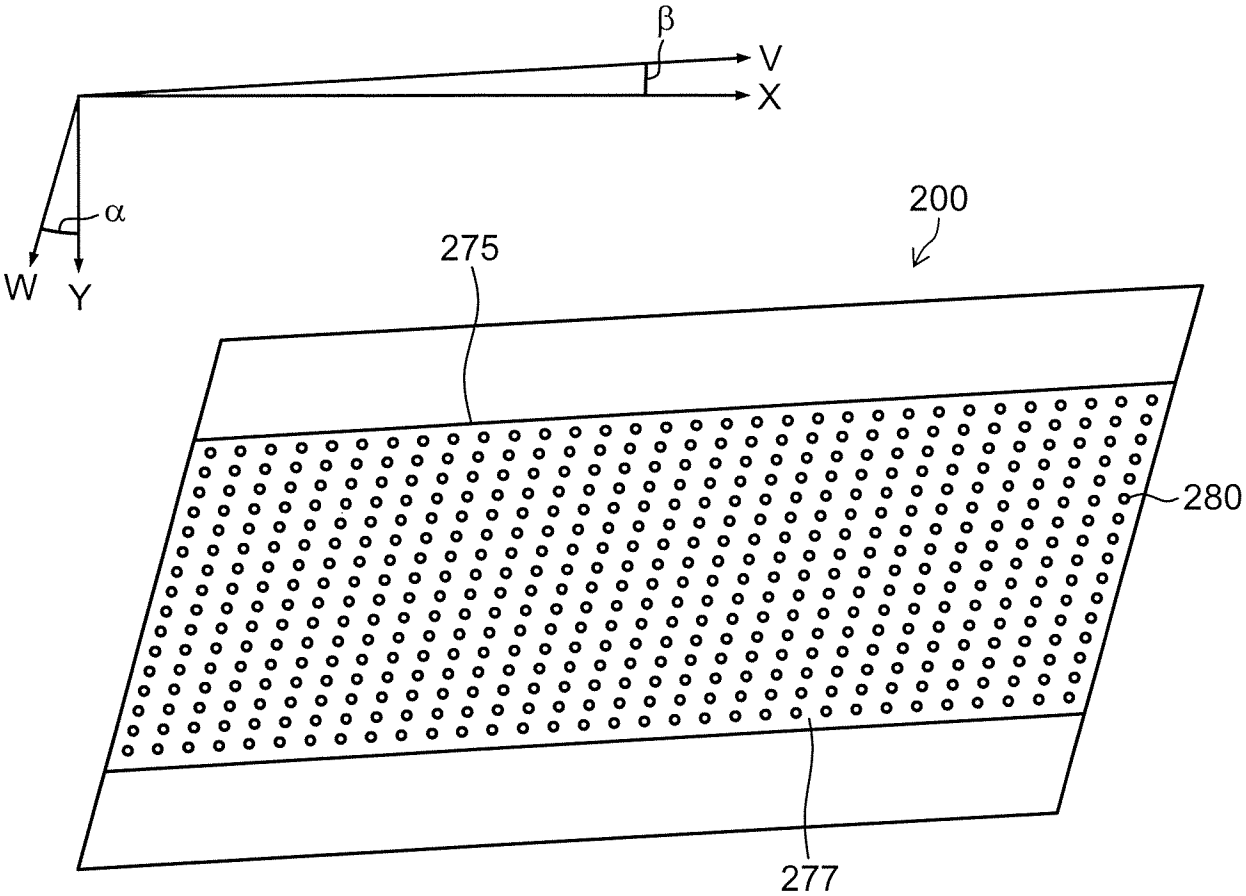
FIG. 5 is a perspective plan view of a liquid ejection surface in the head module.

FIG. 4 is a perspective view of the head module and a view including a partial sectional view. FIG. 5 is a perspective plan view of the liquid ejection surface in the head module.

As illustrated in FIG. 4, the head module 200 includes an ink supply unit. The ink supply unit includes an ink supply chamber 232 and an ink circulation chamber 236.

The ink supply chamber 232 and the ink circulation chamber 236 are disposed on a side opposite to the ejection surface 277 of a nozzle plate 275. The ink supply chamber 232 is connected to an ink tank, not shown, through a supply pipeline 252. The ink circulation chamber 236 is connected to a recovery tank, not shown, through a circulation pipeline 256.

In FIG. 5, the number of the nozzle openings 280 is omitted. On the surface of the ejection surface 277 of the nozzle plate 275 of the single head module 200, a plurality of the nozzle openings 280 is disposed in two-dimensional arrangement.

That is, the head module 200 has a parallelogram plan shape having an end surface on a longer side along a V-direction having inclination of an angle β with respect to the X-direction and an end surface on a shorter side along a W-direction having inclination of an angle α with respect to the Y-direction, and a plurality of the nozzle openings 280 is matrix-arranged in a row direction along the V-direction and a column direction along the W-direction.

The arrangement of the nozzle openings 280 is not limited to the mode illustrated in FIG. 5 but the plurality of nozzle openings 280 may be disposed along the row direction along the X-direction and the column direction diagonally crossing the X-direction.

Here, the matrix arrangement of the nozzle openings 280 is arrangement of the nozzle openings 280 in which an arrangement distance interval of the nozzle openings 280 is uniform in a projection nozzle row in the X-direction in which the plurality of nozzle openings 280 is disposed along the X-direction obtained by projecting the plurality of nozzle openings 280 in the X-direction.

In the liquid ejection head 56 illustrated in this embodiment, in a connection portion between the adjacent head modules 200 in the projected nozzle row in the X-direction, the nozzle openings 280 belonging to one of the head modules 200 and the nozzle openings 280 belonging to the other head module 200 are mixed.

If there is no error of a mounting position of each of the head modules 200, since the nozzle openings 280 belonging to the one head module 200 and the nozzle openings 280 belonging to the other head module 200 in the connection area are disposed at the same position, the arrangement of the nozzle openings 280 is uniform also in the connection area.

In the following description, the head modules 200 constituting the liquid ejection head 56 are assumed to be mounted without an error of the mounting positions.

<Internal Structure of Head Module>

FIG. 6 is a sectional view illustrating an internal structure of the head module. The head module 200 includes an ink supply path 214, an individual supply path 216, a pressure chamber 218, a nozzle communication path 220, a circulation individual channel 226, a circulation common channel 228, a piezoelectric element 230, and a diaphragm 266.

The ink supply path 214, the individual supply path 216, the pressure chamber 218, the nozzle communication path 220, the circulation individual channel 226, and the circulation common channel 228 are formed in a channel structural body 210. The nozzle portion 281 may include the nozzle opening 280 and the nozzle communication path 220.

The individual supply path 216 is a channel connecting the pressure chamber 218 and the ink supply path 214. The nozzle communication path 220 is a channel connecting the pressure chamber 218 and the nozzle opening 280. The circulation individual channel 226 is a channel connecting the nozzle communication path 220 and the circulation common channel 228.

On the channel structural body 210, the diaphragm 266 is provided. On the diaphragm 266, the piezoelectric element 230 is disposed through an adhesive layer 267. The piezoelectric element 230 has a laminated structure of a lower electrode 265, a piezoelectric body layer 231, and an upper electrode 264. The lower electrode 265 is called a common electrode in some cases, and the upper electrode 264 is called an individual electrode in some cases.

The upper electrode 264 is the individual electrode which is patterned in correspondence with a shape of each of the pressure chambers 218, and the piezoelectric element 230 is provided in each of the pressure chambers 218, respectively.

The ink supply path 214 is connected to the ink supply chamber 232 described in FIG. 4. The ink is supplied from the ink supply path 214 through the individual supply path 216 to the pressure chamber 218. When the driving voltage is applied to the upper electrode 264 of the piezoelectric element 230 which is an operation target in accordance with the image data, the piezoelectric element 230 and the diaphragm 266 are deformed, and a capacity of the pressure chamber 218 is changed.

The head module 200 can cause an ink droplet to be ejected from the nozzle opening 280 through the nozzle communication path 220 by a pressure change involved in the change of the capacity of the pressure chamber 218.

The head module 200 can cause the ink droplet to be ejected from the nozzle opening 280 by controlling driving of the piezoelectric element 230 corresponding to each of the nozzle openings 280 in accordance with the dot data generated from the image data.

By controlling the ejection timing of the ink droplet from each of the nozzle openings 280 illustrated in FIG. 5 in accordance with the conveyance speed of the sheet S while the sheet S illustrated in FIG. 3 is being conveyed in the sheet conveyance direction at a constant speed, a desired image is formed on the sheet S.

Though not shown, the pressure chamber 218 provided in correspondence with each of the nozzle openings 280 has a substantially regular square plane shape in which an outflow port to the nozzle opening 280 is provided on one of both corner portions on a diagonal line and the individual supply path 216 which is an inflow port of the supply ink is provided on the other.

The shape of the pressure chamber is not limited to a regular square. The plane shape of the pressure chamber can be various forms such as a square including a diamond and a rectangle, a pentagon, a hexagon and other polygons, a circle, an ellipse and the like.

In the nozzle portion 281 including the nozzle opening 280 and the nozzle communication path 220, a circulation outlet, not shown, is formed. The nozzle portion 281 is made to communicate with the circulation individual channel 226 through the circulation outlet. In the ink in the nozzle portion 281, the ink not used for ejection is recovered to the circulation common channel 228 through the circulation individual channel 226.

The circulation common channel 228 is connected to the ink circulation chamber 236 described in FIG. 4. Since the ink is recovered into the circulation common channel 228 through the circulation individual channel 226 at all times, thickening of the ink in the nozzle portion during a non-ejection period is prevented.

FIG. 6 exemplifies the piezoelectric element 230 having a structure individually separated in correspondence with each of the nozzle portions 281 as an example of the piezoelectric element. It is natural that a structure in which the piezoelectric body layer 231 is integrally formed to the plurality of the nozzle portions 281, the individual electrode is formed in correspondence with each of the nozzle portions 281, and an active area is formed for each of the nozzle portions 281 may be applied.

The head module 200 may include a heater inside the pressure chamber 218 as a pressure generating element instead of the piezoelectric element. To the head module 200, a thermal method may be applied in which the driving voltage is supplied to heat the heater, and the ink in the pressure chamber 218 is ejected from the nozzle opening 280 by using a film boiling phenomenon.

[Detailed Description of Parameter Setting Unit]

Figure 7:
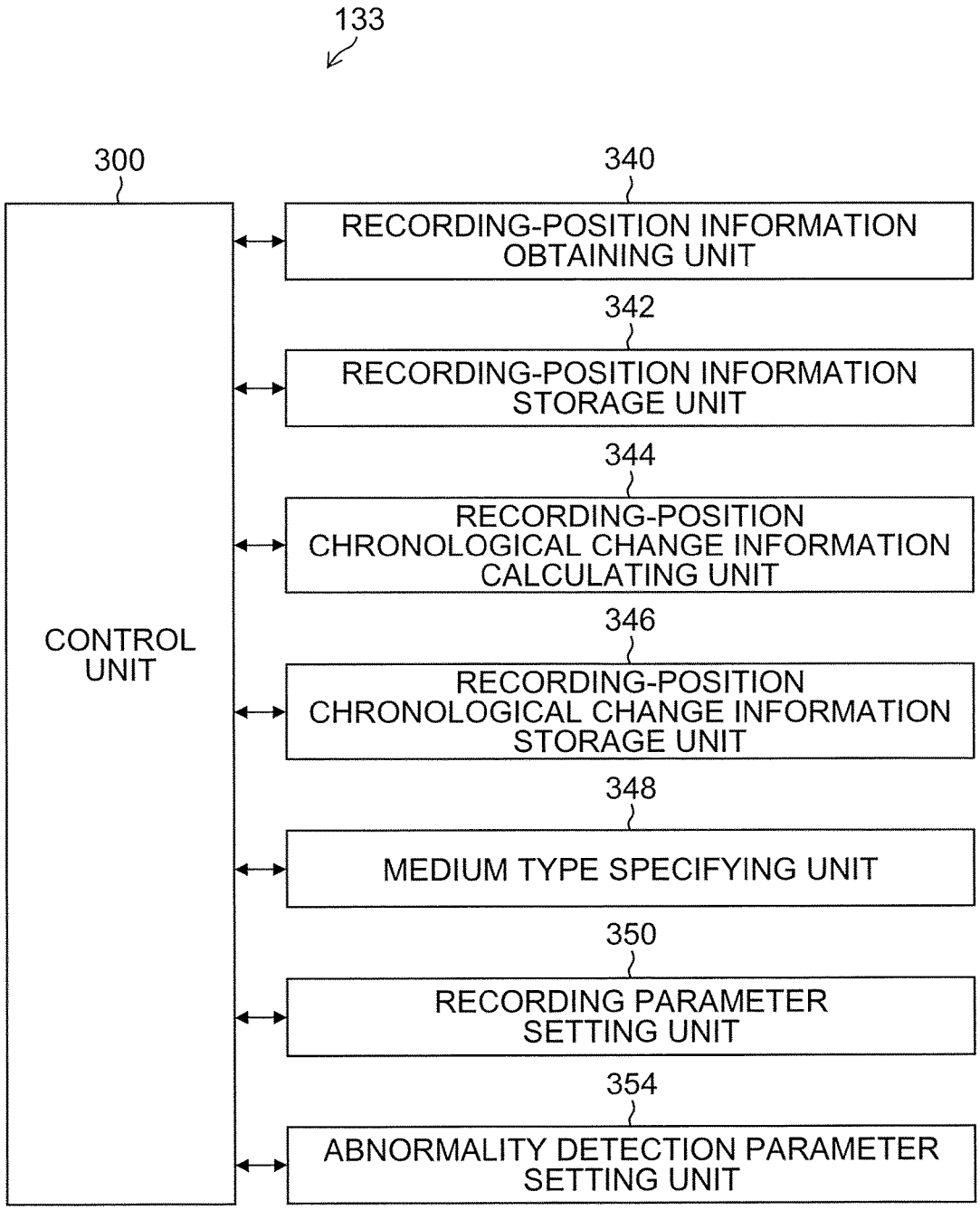
FIG. 7 is a block diagram illustrating outline configuration of a parameter setting unit illustrated in FIG. 2.

Subsequently, details of the parameter setting unit illustrated in FIG. 2 will be described. FIG. 7 is a block diagram illustrating outline configuration of the parameter setting unit illustrated in FIG. 2.

The parameter setting unit 133 illustrated in FIG. 7 includes a control unit 300. The control unit 300 controls each portion of the parameter setting unit 133 in an integrated manner. The control unit 300 may be also used as the system controller 100 illustrated in FIG. 2.

The parameter setting unit 133 illustrated in FIG. 7 includes a recording-position information obtaining unit 340 and a recording-position information storage unit 342. The recording-position information obtaining unit 340 obtains recording position information indicating an actual recording position for each of the nozzle portions 281 illustrated in FIG. 6. The obtainment of the recording position information may be carried out such that the recording position is measured for each of the nozzle portions 281 or the recording position information measured in advance for each of the nozzle portions 281 is obtained.

The actual recording position for each of the nozzle portions 281 in this embodiment is an actual landing position of the ink droplet ejected from each of the nozzle portions 281.

The obtainment of the recording position information by using the recording-position information obtaining unit 340 is carried out twice or more by providing an arbitrary interval for each of the nozzle portions 281. The obtainment of the recording position information may be an integer times of a cycle of image recording.

For example, when the recording position measurement is carried out for one head on the single sheet S illustrated in FIG. 1, the obtainment of the recording position of each of the nozzle portions 281 is carried out for each period corresponding to a drawing period of four sheets S. That is, the aforementioned integer times is set to 4 times.

The recording position information for each of the nozzle portions 281 obtained by using the recording-position information obtaining unit 340 is stored in the recording-position information storage unit 342. In the recording-position information storage unit 342, two pieces or more of the recording position information is stored for each of the nozzle portions 281. Details of the obtainment of the recording position information and storage of the recording position information will be described later.

The parameter setting unit 133 illustrated in FIG. 7 includes a recording-position chronological change information calculating unit 344 and a recording-position chronological change information storage unit 346. The recording-position chronological change information calculating unit 344 calculates a standard deviation $\sigma_t$ of an error of the recording position for each of the nozzle portions 281 indicating a change in the recording position caused by elapse of time for each of the nozzle portions 281. Hereinafter, $\sigma_t$ is described as the standard deviation for each of the nozzle portions 281.

Moreover, in the recording-position chronological change information calculating unit 344, an average value $\sigma_{AVE}$ of the standard deviation $\sigma_t$ for each of the nozzle portions 281 in the plurality of nozzle portions 281 and a median value $\sigma_{MED}$ of the standard deviation for each of the nozzle portions 281 in the plurality of nozzle portions 281 are calculated.

The recording-position chronological change information only needs to include at least any one of the standard deviation $\sigma_f$ for each of the nozzle portions 281, the average value $\sigma_{AVE}$ of the standard deviation $\sigma_t$ for each of the nozzle portions 281 and a median value $\sigma_{MED}$ of the standard deviation $\sigma_t$ for each of the nozzle portions 281.

The recording-position chronological change information for each of the nozzle portions 281 calculated by using the recording-position chronological change information calculating unit 344 is stored in the recording-position chronological change information storage unit 346.

The parameter setting unit 133 illustrated in FIG. 7 includes a medium type specifying unit 348. In the medium type specifying unit 348, by using the recording-position chronological change information for each of the nozzle portions 281 calculated by using the recording-position chronological change information calculating unit 344, a type of the medium which is the type of the sheet S used for image recording is specified.

If a relationship between the recording-position chronological change information for each of the nozzle portions 281 and the type of the medium is acquired and stored in advance, the recording-position chronological change information for each of the nozzle portions 281 is used and from the relationship between the recording-position chronological change information for each of the nozzle portions 281 stored in advance and the type of the medium, the type of the medium corresponding to the recording-position chronological change information for each of the nozzle portions 281 can be read out.

The parameter setting unit 133 illustrated in FIG. 7 includes a recording parameter setting unit 350. In the recording parameter setting unit 350, on the basis of the type of the medium corresponding to the recording-position chronological change information for each of the nozzle portions 281, a recording parameter which is a parameter in the image recording is automatically set.

As the recording parameter in the inkjet recording apparatus 10 illustrated in this embodiment, a deposition amount, an ejection abnormality correction coefficient, an unevenness correction coefficient, and the halftone processing rule are cited. The recording parameter setting unit 350 is a constituent element of the parameter setting unit. The deposition amount is a mode of the output gradation number.

The recording parameter automatically set by using the recording parameter setting unit 350 is stored in the parameter storage unit 134 illustrated in FIG. 2. The recording parameter stored in the parameter storage unit 134 is used for image processing in the image processing unit of the drawing control unit 118 illustrated in FIG. 2.

The parameter setting unit 133 illustrated in FIG. 7 includes an abnormality detection parameter setting unit 354. In the abnormality detection parameter setting unit 354, on the basis of the type of the medium corresponding to the recording-position chronological change information for each of the nozzle portions 281, an abnormality detection parameter which is a parameter of abnormality detection is automatically set.

As the parameter of the abnormality detection, an abnormality detection procedure which is an algorithm of the abnormality detection and an abnormality detection threshold value which is a threshold value in the abnormality detection are cited. The procedure of the abnormality detection is called an algorithm of the abnormality detection in some cases.

When measurement of the recording position for each of the nozzle portions 281 is carried out by using the inline sensor 58 illustrated in FIG. 1, in the abnormality detection parameter setting unit 354, an optical detection threshold value of the inline sensor 58 may be automatically set as the parameter of the abnormality detection.

The optical detection threshold value of the inline sensor 58 is a mode of a measurement threshold value in the recording position information obtainment. The abnormality detection parameter setting unit 354 is a constituent element of the detection parameter setting unit.

The parameter of the abnormality detection automatically set by using the abnormality detection parameter setting unit 354 is stored in the parameter storage unit 134 illustrated in FIG. 2. Various parameters in the abnormality detection stored in the parameter storage unit 134 are used for the abnormality detection in the abnormality detecting unit 126 illustrated in FIG. 2.

The parameter storage unit 134 illustrated in FIG. 2 can be configuration including a recording parameter storage unit and an abnormality detection parameter storage unit.

In FIG. 7, each portion is listed for each function. Each portion illustrated in FIG. 7 can be integrated, separated, shared or omitted as appropriate. Moreover, each portion illustrated in FIG. 7 can be configured by combining hardware and software as appropriate. Furthermore, each configuration illustrated in FIG. 2 and each configuration illustrated in FIG. 7 can be integrated, separated, shared or omitted as appropriate.

[Description of Parameter Setting Method]

Figure 8:
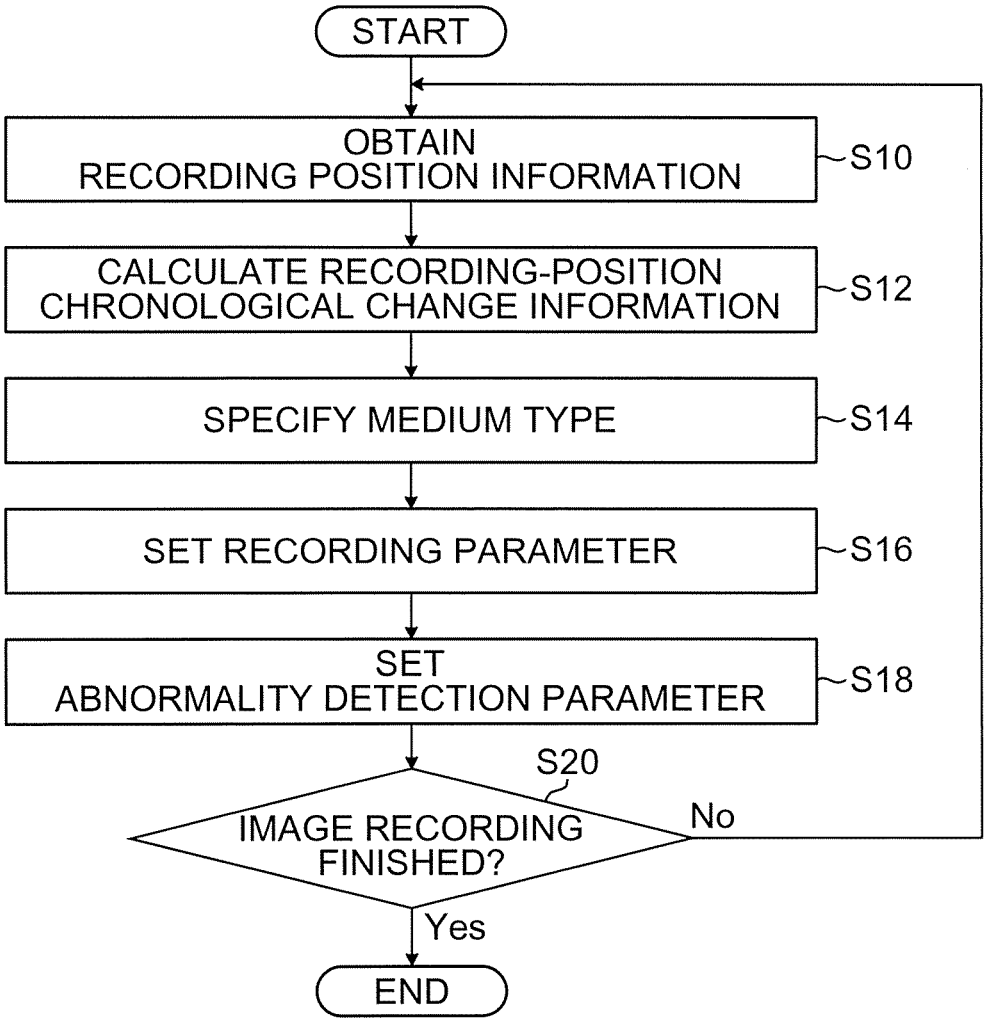
FIG. 8 is a flowchart illustrating a procedure of a parameter setting method.

Subsequently, a parameter setting method will be described. FIG. 8 is a flowchart illustrating a procedure of the parameter setting method.

In the parameter setting method described below, the type of the medium is specified on the basis of the recording position information for each of the nozzle portions 281 obtained a plurality of times regularly or irregularly, and on the basis of the specified type of the medium, at least either one of the recording parameter and the abnormality detection parameter is automatically set.

When the parameter setting method is started, at a recording-position information obtaining process S10, the recording position information indicating the recording position of each of the nozzle portions 281 is obtained. The recording-position information obtaining process S10 is executed in the recording-position information obtaining unit 340 illustrated in FIG. 7.

At the recording-position information obtaining process S10 illustrated in FIG. 8, when a plurality of the recording position information is obtained for each of the nozzle portions 281, the routine proceeds to a recording-position chronological change information calculating process S12.

At the recording-position chronological change information calculating process S12, as an index indicating a chronological change of the recording position for each of the nozzle portions 281, the standard deviation $\sigma_t$ for each of the nozzle portions 281 is calculated. Moreover, for the plurality of the nozzle portions 281 included in a single head, the average value $\sigma_{AVE}$ of the standard deviation $\sigma_t$ and the median value $\sigma_{MED}$ of the standard deviation $\sigma_t$ are calculated. For the plurality of the nozzle portions 281 included in the single head module, the average value $\sigma_{AVE}$ of the standard deviation $\sigma_t$ and the median value $\sigma_{MED}$ of the standard deviation $\sigma_t$ may be calculated.

A calculation result at the recording-position chronological change information calculating process S12 is stored in the parameter storage unit 134 illustrated in FIG. 2.

The recording-position chronological change information calculating process S12 illustrated in FIG. 8 is executed in the recording-position chronological change information calculating unit 344 illustrated in FIG. 7. At the recording-position chronological change information calculating process S12 illustrated in FIG. 8, when the recording-position chronological change information is calculated, the routine proceeds to a medium type specifying process S14.

At the medium type specifying process S14, the type of the medium is specified by using the recording-position chronological change information calculated at the recording-position chronological change information calculating process S12. The medium type specifying process S14 is executed in the medium type specifying unit 348 illustrated in FIG. 7.

When the type of the medium is specified at the medium type specifying process S14 illustrated in FIG. 8, the routine proceeds to a recording parameter setting process S16. At the recording parameter setting process S16, the recording parameter is automatically set by using the type of the medium specified at the medium type specifying process S14.

The recording parameter set at the recording parameter setting process S16 is stored in the parameter storage unit 134 illustrated in FIG. 2. The recording parameter setting process S16 illustrated in FIG. 8 is executed in the recording parameter setting unit 350 illustrated in FIG. 7.

At the recording parameter setting process S16 illustrated in FIG. 8, when the recording parameter is automatically set, the routine proceeds to the abnormality detection parameter setting process S18. At the abnormality detection parameter setting process S18, the abnormality detection parameter is automatically set by using the type of the medium specified at the medium type specifying process S14.

The abnormality detection parameter set at the abnormality detection parameter setting process S18 is stored in the parameter storage unit 134 illustrated in FIG. 2. The abnormality detection parameter setting process S18 illustrated in FIG. 8 is executed in the abnormality detection parameter setting unit 354 illustrated in FIG. 7.

At the abnormality detection parameter setting process S18 illustrated in FIG. 8, when the abnormality parameter is automatically set, an image recording end determining process S20 is executed. At the image recording end determining process S20, it is determined whether or not the image recording being executed at present is to be finished.

If the image recording end determining process S20 gives NO determination that the image recording is not to be finished, the image recording being executed at present is to be continued. If the image recording being executed at present is to be continued, the routine returns to the recording-position information obtaining process S10, and the processes from the recording-position information obtaining process S10 to the image recording end determining process S20 are repeatedly executed.

On the other hand, if the image recording end determining process S20 gives YES determination that the image recording is to be finished, end processing of the image recording being executed at present is executed, and the image recording being executed at present is finished.

FIG. 8 exemplifies a mode in which both the recording parameter setting process S16 and the abnormality detection parameter setting process S18 are executed, but the recording parameter setting process S16 or the abnormality detection parameter setting process S18 may be omitted in some cases.

[Specific Example of Recording Position Measurement]

Figure 9:
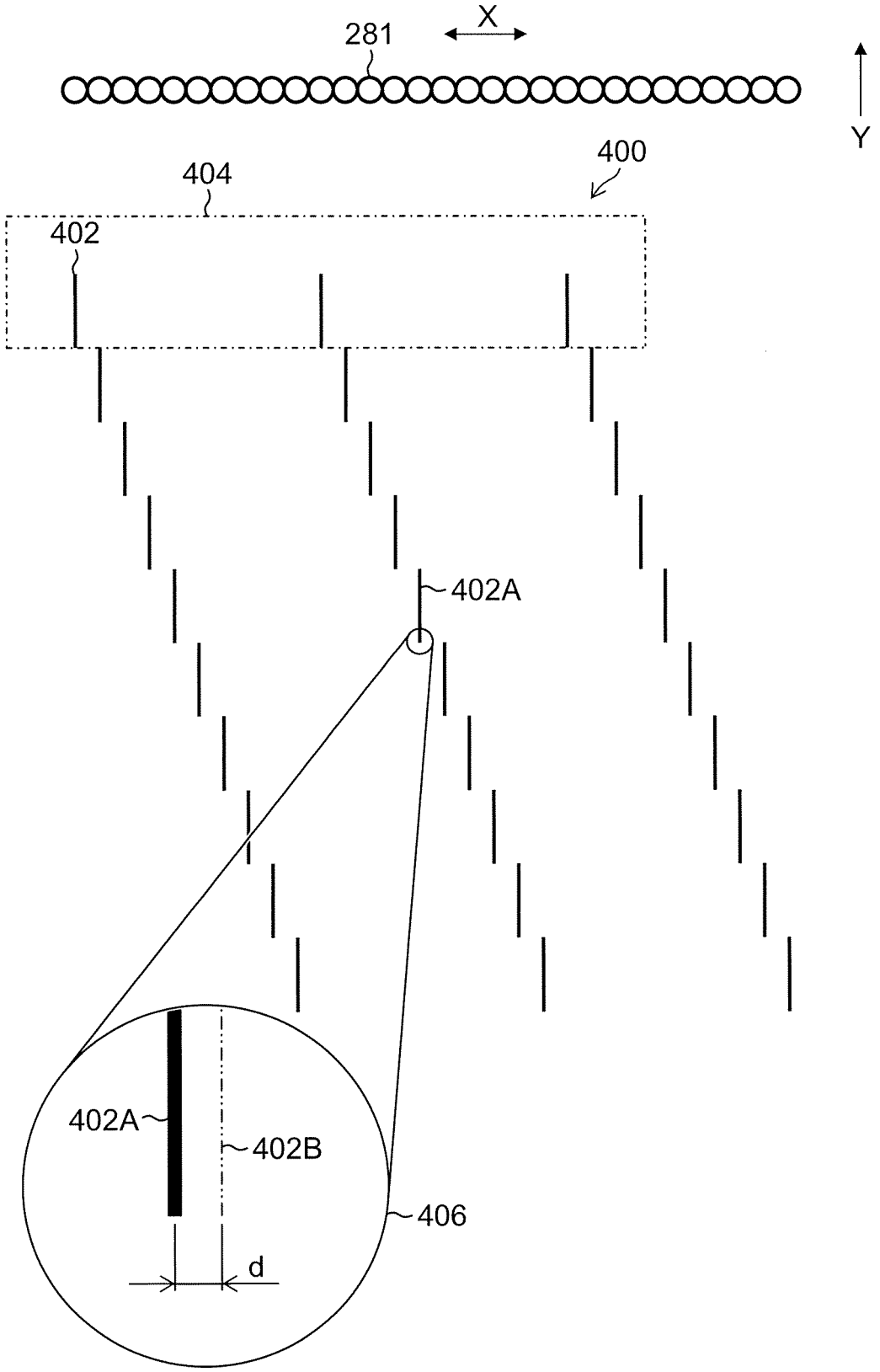
FIG. 9 is an explanatory view of obtainment of recording position information.

Subsequently, a specific example of recording position measurement will be described. FIG. 9 is an explanatory view of the recording position measurement. FIG. 9 schematically illustrates the plurality of nozzle portions 281 and a recording position measurement pattern 400 applied to the recording position measurement. The nozzle portions 281 illustrated in FIG. 9 are a part of the nozzle portions 281 included in the liquid ejection head 56 illustrated in FIG. 3.

The recording position measurement pattern 400 illustrated in FIG. 9 is called a 1-on N-off pattern, and dot rows 402 formed by using each of the nozzle portions 281 for all the nozzle portions 281 are included.

FIG. 9 illustrates a case where N is 9. That is, in the recording position measurement pattern 400 illustrated in FIG. 9, the dot rows 402 are disposed at 10 nozzle intervals in the direction orthogonal to the sheet conveyance direction.

Then, a dot row group 404 in which positions of the dot rows 402 are shifted in order by one nozzle in the direction orthogonal to the sheet conveyance direction is disposed in 10 stages along the sheet conveyance direction. A forming method of the recording position measurement pattern 400 illustrated in FIG. 9 is known, and detailed description here is omitted.

Reading data obtained by optically reading the recording position measurement pattern 400 is analyzed, and the actual recording position of each nozzle portion 281 can be grasped.

A circle illustrated with reference numeral 406 in FIG. 9 illustrates an arbitrary dot row 402A of the recording position measurement pattern 400 in an enlarged manner. A one-dot chain line with reference character 402B illustrated in the circle with reference numeral 406 designates a theoretical recording position which is a position where the dot row 402A should be formed.

The dot row 402A illustrated in FIG. 9 is disposed at a position shifted only by a distance d in the direction orthogonal to the sheet conveyance direction from the theoretical recording position 402B. In the recording position measurement, the theoretical recording position 402B may be measured or the distance d to the actual recording position from the theoretical recording position 402B may be measured.

The recording position measurement described here is an example, and if the recording position information capable of calculating the recording-position chronological change information described below is obtained, the recording position measurement is not limited to the example described here.

The obtainment of the recording position information may be carried out such that the first obtainment of the recording position information is carried out before job start. Moreover, the recording position information obtained when ejection states of each of the nozzle portions 281 after maintenance processing of the liquid ejection head 56C, the liquid ejection head 56M, the liquid ejection head 56Y, and the liquid ejection head 56K illustrated in FIG. 1 may be used.

The job here is image recording handled as a series of image recording. As an example of the job, a mode in which the same image data is used and the image recording is carried out for a plurality of mediums is cited. The image data may include a plurality of pages.

Moreover, the recording position information obtained during execution of the job and used for correction of each of the nozzle portions 281 may be used. That is, from reading data of the recording position measurement pattern formed on a margin of the sheet S or the like during the execution of the job, the recording position information for each nozzle portion 281 during job execution may be obtained.

Since the recording position information for each nozzle portion 281 is used, and the recording-position chronological change information for each nozzle portion 281 is calculated, the recording position information for each nozzle portion 281 needs to be obtained twice or more.

In this embodiment, a mode in which the inline sensor 58 included in the inkjet recording apparatus 10 illustrated in FIG. 1 is used for measurement of the recording position is exemplified, but for the measurement of the recording position, instead of the inline sensor 58, a scanner device or the like installed outside of the inkjet recording apparatus 10 may be used.

[Specific Example of Recording-Position Chronological Change Information Calculation]

Subsequently, a specific example of recording-position chronological change information calculation will be described. When the recording position information is obtained a plurality of times for each nozzle portion 281, the recording-position chronological change information for each nozzle portion 281 is calculated by using the obtained recording position information. In this embodiment, the standard deviation $\sigma_t$ of the recording position is calculated for each nozzle portion 281 as the recording-position chronological change information.

Moreover, when the standard deviation $\sigma_t$ for each nozzle portion 281 is calculated, for the plurality of nozzle portions 281 included in a single head, the average value $\sigma_{AVE}$ of the standard deviation $\sigma_t$ for each nozzle portion 281, and for the plurality of nozzle portions 281 included in the single head, the median value $\sigma_{MED}$ of the standard deviation $\sigma_t$ for each nozzle portion 281 is calculated.

In the following [Table 1], an example of the recording-position chronological change information calculation in the case of the number of the nozzle portions 281 is 21 and when the distance d to the actual recording position from the intrinsic recording position illustrated in FIG. 9 is obtained as the recording position information and in the case where the recording position information is obtained four times is illustrated.

Hereinafter, the distance d of the actual recording position from the intrinsic recording position is described as an error of the recording position. A unit of the error of the recording position illustrated in [Table 1] below and a unit of the standard deviation are micrometer.

TABLE 1

| NOZZLE PORTION NUMBER | FIRST SESSION | SECOND SESSION | THIRD SESSION | FOURTH SESSION | $\sigma_t$ |
|---|---|---|---|---|---|
| 1 | −0.9 | −0.68 | −1.06 | −1 | 0.17 |
| 2 | 0.47 | 0.65 | 0.2 | 0.12 | 0.24 |
| 3 | 0.16 | 0.83 | 0.25 | 0.19 | 0.32 |
| 4 | −0.08 | −0.3 | −0.39 | −0.61 | 0.22 |
| 5 | −0.13 | −0.39 | −0.03 | −0.3 | 0.16 |
| 6 | −1.15 | −1.4 | −1.6 | −2.48 | 0.58 |
| 7 | 10.9 | 16.1 | 14.3 | 15 | 2.24 |
| 8 | 0.43 | 0.7 | 0.02 | −0.93 | 0.71 |
| 9 | −1.64 | −0.25 | −1.69 | −1.09 | 0.67 |
| 10 | 1.11 | 1.28 | 0.9 | 0.96 | 0.17 |
| 11 | 0.42 | 0.25 | 0.13 | −0.24 | 0.28 |
| 12 | −1.01 | −1.56 | 5.6 | −1.69 | 3.52 |
| 13 | −1.62 | −0.8 | −1.5 | −0.96 | 0.40 |
| 14 | 1.88 | 0.69 | 0.96 | 0.9 | 0.53 |
| 15 | 1.98 | 1.8 | 2.04 | 1.65 | 0.18 |
| 16 | −1.32 | −0.65 | −1.67 | −0.5 | 0.55 |
| 17 | −0.22 | −1.08 | −0.59 | −0.81 | 0.36 |
| 18 | −0.75 | −0.15 | −0.09 | −1.05 | 0.47 |
| 19 | 1.39 | 1.46 | 1.69 | 1.31 | 0.16 |
| 20 | −0.36 | −0.5 | −0.42 | 0.63 | 0.53 |
| 21 | 0.75 | 1.31 | −0.09 | 0.67 | 0.58 |
| | | | | $\sigma_{AVE}$ | 0.62 |
| | | | | $\sigma_{MED}$ | 0.40 |

In the case where new recording position information is obtained, such a mode is preferable that the newly obtained recording position information is used and the recording position chronological change information is updated.

For example, the recording-position chronological change information may be updated by using all the recording position information including the latest recording position information or the recording-position chronological change information may be updated by using the recording position information for a certain number of times including the latest recording position information.

The standard deviation $\sigma_t$ for each of the nozzle portions 281 can be calculated by using the following equation:

$$\sigma_t^2=\sigma_{t1}^2+\sigma_{t2}^2+\sigma_{t3}^2.$$

Reference character $\sigma_{t1}$ designates an element of the standard deviation $\sigma_t$ derived from optical system. Reference character $\sigma_{t2}$ designates an element of the standard deviation $\sigma_t$ derived from the sheet S. Reference character $\sigma_{t3}$ designates an element of the standard deviation $\sigma_t$ derived from ejection.

The element $\sigma_{t1}$ derived from optical system is an element of the standard deviation $\sigma_t$ caused by the optical system such as an imaging element used for the recording position measurement including the inline sensor 58 illustrated in FIG. 1, an illumination light and the like. In this embodiment, the element $\sigma_{t1}$ derived from optical system is a fixed value depending on a place in the sheet S.

The element $\sigma_{t2}$ derived from sheet is an element depending on the type of the sheet S. The element $\sigma_{t2}$ derived from sheet has a tendency to become larger in order of gloss paper, mat paper, and high-quality paper.

When the recording position measurement pattern 400 illustrated in FIG. 9 is continuously formed, a load on each nozzle portion 281 caused by the ejection is small, and the element $\sigma_{t3}$ derived from ejection is extremely smaller than the element $\sigma_{t2}$ derived from sheet. That is, the element $\sigma_{t3}$ derived from ejection can be considered as a fixed value.

That is, when the element $\sigma_{t1}$ derived from optical system and the element $\sigma_{t3}$ derived from ejection are ignorable, the standard deviation $\sigma_t$ can be handled as the element $\sigma_{t2}$ derived from sheet. Then, by using the value of the standard deviation $\sigma_t$ for each nozzle portion 281, the type of the medium for which the recording position information is obtained can be specified.

For example, a threshold value determined on the basis of a range of the standard deviation $\sigma_t$ corresponding to the gloss paper and a range of the standard deviation $\sigma_t$ corresponding to the mat paper are compared with the calculated standard deviation $\sigma_t$. If the calculated standard deviation $\sigma_t$ is not larger than the threshold value, it can be specified as the gloss paper. Moreover, if the calculated standard deviation $\sigma_t$ exceeds the threshold value, it can be specified as the mat paper.

That is, since the threshold value used for specification of the type of the medium is determined on the basis of the range that the standard deviation $\sigma_t$ can take for the type of the medium which is likely to be used, the type of the medium for which the calculated standard deviation $\sigma_t$ is used can be specified.

In specification of the type of the medium, the average value $\sigma_{AVE}$ of the standard deviation $\sigma_t$ for each nozzle portion 281 may be calculated for the plurality of nozzle portions 281 included in the single head, and the average value $\sigma_{AVE}$ of the standard deviation $\sigma_t$ for each nozzle portion 281 may be used.

In specification of the type of the medium, the median value $\sigma_{MED}$ of the standard deviation $\sigma_t$ for each nozzle portion 281 may be calculated for the plurality of nozzle portions 281 included in the single head, and the median value $\sigma_{MED}$ of the standard deviation $\sigma_t$ for each nozzle portion 281 may be used.

Moreover, when the average value $\sigma_{AVE}$ of the standard deviation $\sigma_t$ for each nozzle portion 281 or the median value $\sigma_{MED}$ of the standard deviation $\sigma_t$ for each nozzle portion 281 is calculated, the plurality of nozzle portions 281 may be the plurality of nozzle portions 281 included in the head module 200.

As the recording-position chronological change information, by using the average value $\sigma_{AVE}$ for the head or the head module of the standard deviation $\sigma_t$ for each nozzle portion 281 or the median value $\sigma_{MED}$ for the head or the head module of the standard deviation $\sigma_t$ for each nozzle portion 281, an influence caused by a state where the element $\sigma_{t3}$ derived from ejection in the abnormal nozzle portion becomes larger, and the standard deviation $\sigma_t$ of the abnormal nozzle becomes larger is suppressed.

Moreover, such a mode is preferable that the average value $\sigma_{AVE}$ for the head or the head module or the median value $\sigma_{MED}$ for the head or the head module is calculated by using only the standard deviation $\sigma_t$ of the nozzle portion 281 whose recording position error is at a certain level or less.

Such a mode is preferable that an upper limit value and a lower limit value of the recording position error is set, and the recording position error exceeding the upper limit value or the recording position error less than the lower limit value is not applied to calculation of the average value $\sigma_{AVE}$ of the standard deviation $\sigma_t$ for each nozzle portion 281 or to the calculation of the median value $\sigma_{MED}$ of the standard deviation $\sigma_t$ for each nozzle portion 281.

For example, in the aforementioned [Table 1], when the upper limit value 1.20 micrometers is set to the standard deviation $\sigma_t$ for each nozzle portion 281, the nozzle portion with the nozzle number 7 and the nozzle portion with the nozzle number 12 exceed the upper limit value.

Then, the nozzle portion with the nozzle number 7 and the nozzle portion with the nozzle number 12 may be determined to be the nozzle portion 281 where ejection abnormality occurs.

Therefore, in 21 nozzles illustrated in the aforementioned [Table 1], the standard deviation $\sigma_t$ of the nozzle portion with the nozzle number 7 and the standard deviation $\sigma_t$ of the nozzle portion with the nozzle number 12 are not applied, while the standard deviation $\sigma_t$ of each of the nozzle portions with the nozzle numbers 1 to 6, the standard deviation $\sigma_t$ of each of the nozzle portions with the nozzle numbers 8 to 11, and the standard deviation $\sigma_t$ of each of the nozzle portions with the nozzle numbers 13 to 21 are used, and the average value $\sigma_{AVE}$ of the standard deviation $\sigma_t$ for each nozzle portion or the median value $\sigma_{MED}$ of the standard deviation $\sigma_t$ for each nozzle portion is calculated.

The upper limit value when it is determined that the nozzle portion is a nozzle portion where ejection abnormality has occurred or not may be an integer times of three times or more of the standard deviation $\sigma_t$ for each nozzle portion 281. Instead of the standard deviation $\sigma_t$ for each nozzle portion 281, the average value $\sigma_{AVE}$ of the standard deviation $\sigma_t$ for each nozzle portion 281 may be applied and a threshold value when it is determined that the nozzle portion is a nozzle portion where ejection abnormality has occurred or not may be set for each head or for each head module.

[Specific Example of Medium Type Specification]

A specific example of medium type specification for which the example of the recording-position chronological change information illustrated in the aforementioned [Table 1] is used will be described.

In an apparatus in which the gloss paper and the mat paper are used, for example, it is assumed that a medium type specification threshold value between the gloss paper and the mat paper is set to 0.50 micrometers, if the median value $\sigma_{MED}$ of the standard deviation $\sigma_t$ for each nozzle portion 281 is 0.50 micrometers or less, it is determined as the gloss paper, and if the median value $\sigma_{MED}$ of the standard deviation $\sigma_t$ for each nozzle portion 281 exceeds 0.50 micrometers, it is determined as the mat paper.

From the aforementioned [Table 1], the median value $\sigma_{MED}$ of the standard deviation $\sigma_t$ for each nozzle portion 281 is 0.40 micrometers and thus, the type of the medium in use is determined to be the gloss paper. In the recording parameter setting unit 350 illustrated in FIG. 7, the recording parameter corresponding to the gloss paper can be set. In the abnormality detection parameter setting unit 354, the abnormality detection parameter corresponding to the gloss paper can be set.

Such a mode is preferable that for a medium which is likely to be used, a medium type specification threshold value is derived in advance, and a relationship between the type of the medium and the medium type specification threshold value is stored. In this mode, when the medium to be used is set, the information of the type of the medium is used, and the medium type specification threshold value can be read out from the relationship between the type of the medium and the medium type specification threshold value.

By reviewing the medium type specification threshold value regularly by using the standard medium and by correcting the medium type specification threshold value, the accuracy of specification of the medium type can be improved. For example, when ejection characteristics of the liquid ejection head lower, the medium type specification threshold value can be corrected in correspondence with the lowered ejection characteristics. The ejection characteristics of the liquid ejection head correspond to a recording state of the recording head.

An arbitrary medium may be applied as the standard medium as long as it is a medium which can be based in a plurality of types of mediums. Correction of the medium type specification threshold value for which the standard medium is used is preferably made in a mode in which the recording position information measured regularly by using the standard medium is used.

The correction of the medium type specification threshold value for which the standard medium is used may use the recording position information measured irregularly by using the standard medium. That is, the correction of the medium type specification threshold value for which the standard medium is used may use the recording position information measured at arbitrary timing by using the standard medium.

When the recording position information for which the standard medium is used is obtained a plurality of times, the standard deviation $\sigma_{tR}$ for each nozzle portion 281 in the standard medium can be calculated. The median value $\sigma_{MEDr}$ of the standard deviation $\sigma_{tR}$ for each nozzle portion 281 for which the standard medium is used or the average value $\sigma_{AVEr}$ of the standard deviation $\sigma_t$ for each nozzle portion 281 may be calculated.

For example, if the standard deviation $\sigma_{tR}$ for each nozzle portion 281 in the standard medium is increased, the correction for increasing the medium type specification threshold value can be made. That is, to the standard deviation $\sigma_t$ for each nozzle portion 281 in the medium used in the image recording, a value corresponding to an increase portion of the standard deviation $\sigma_{tR}$ for each nozzle portion 281 in the standard medium is added.

The correction of the medium type specification threshold value for which the standard medium is used is preferably made in a mode in which the recording position information in the plurality of nozzle portions 281 is used. The standard deviations of the recording positions of the plurality of recording elements obtained in one session in the recording position information for which the standard medium is used, for example, is compared with the standard deviations of the plurality of recording positions obtained in one session in the recording position information for which the medium used for the recording is used. The standard deviations of the recording positions of the plurality of recording elements obtained in one session are a mode of the recording position information in the plurality of recording elements obtained in one session.

The medium type specifying unit 348 illustrated in FIG. 7 may determine necessity of the correction of the medium type specification threshold value by using a comparison result of the both. If a differential value of the both is within a range set in advance, it can be determined that the correction of the medium type specification threshold value is not to be executed. If the differential value of the both exceeds the range set in advance, it can be determined that the correction of the medium type specification threshold value is to be executed.

If the differential value of the both exceeds the range set in advance, a medium type specification threshold value correction execution selection screen can be displayed on the display unit 132 illustrated in FIG. 2. Execution or non-execution of the correction may be selected by the user from the medium type specification threshold value correction execution selection screen displayed on the display unit 132. The medium type specifying unit 348 illustrated in FIG. 7 can determine necessity of the correction of the medium type specification threshold value by using a selection result of the user.

When a line-type liquid ejection head is used, a pattern to be read is present along the direction orthogonal to the sheet conveyance direction. When the pattern to be read along the direction orthogonal to the sheet conveyance direction is read out by using a scanner or the like, the same area in the pattern to be read can be read out by using different reading elements in a connection portion of the reading elements or the like.

At such an optically unique position as above, the element $\sigma_{t1}$ derived from optical system in the standard deviation $\sigma_t$ for each nozzle portion 281 is changed. Moreover, if a distance from the light source used in a reading device to the pattern to be read is changed, the element $\sigma_{t1}$ derived from optical system in the standard deviation $\sigma_t$ for each nozzle portion 281 is also changed.

Therefore, by reading optical density of an area in which a specific pattern is formed and by obtaining the density information of the specific pattern, a change in the element $\sigma_{t1}$ derived from optical system in the standard deviation $\sigma_t$ for each nozzle portion 281 can be handled, and accuracy of specification of the medium type can be improved.

Moreover, by reading optical density of the area in which the specific pattern is formed, the medium type specification threshold value can be set for each nozzle portion 281 or each area constituted by using the plurality of nozzle portions 281 with respect to the optically unique position.

[Specific Example of Recording Parameter Setting]

When the type of the medium is specified, recording setting corresponding to the specified medium is carried out. As the recording parameter, the ejection amount, the non-ejection correction coefficient, the density unevenness correction coefficient, and the halftone processing rule are cited.

The ejection amount is an ejection amount when one dot in the liquid ejection head is formed. The ejection amount is a mode of an output gradation value. The non-ejection correction coefficient is a correction coefficient set for another nozzle portion when recording borne by a non-ejection nozzle portion in the liquid ejection head is corrected by using the another nozzle portion. The correction coefficient may be a correction value or may be a correction function. The non-ejection correction coefficient is a mode of an abnormality recording element correction coefficient.

The density unevenness correction coefficient is a correction coefficient set for each nozzle portion when variation in the ejection characteristics for each nozzle portion in the liquid ejection head is to be corrected. The correction coefficient may be a correction value or may be a correction function. The halftone processing rule is a processing rule applied to the halftone processing.

Depending on the type of the medium, a spread rate of a dot size expressing a noise or ease of blurring differs. Depending on the type of the medium, a change occurs in the output density with respect to the ink ejection amount.

Similarly, sharpness on an image end portion or ruggedness of a line or the like is changed.

For various types of the mediums, in order that equivalent density is expressed whichever of the mediums is used, the ejection amount needs to be adjusted on a solid portion for each type of the medium or a parameter of the density unevenness correction coefficient needs to be kept. Moreover, adjustment of the non-ejection correction coefficient is also needed. For the medium with an extremely different spread rate of the dot size, the halftone processing rule may be changed in some cases.

That is, in the recording parameter setting illustrated in this embodiment, any one of the parameters of the ejection amount, the non-ejection correction coefficient, the density unevenness correction coefficient, and the halftone processing rule in correspondence with the specified type of the medium is set.

Such a mode is preferable that the type of the medium and the type of the recording parameter to be set and a relation with the parameter value are determined and stored in advance. In this mode, in the recording parameter setting unit 350 illustrated in FIG. 7, by using the specified type of the medium, from the type of the medium and the type of the recording parameter to be set and the relationship with the parameter value stored in advance, the type of the recording parameter and the parameter value can be read out.

[Specific Example of Abnormality Detection Parameter Setting]

When the type of the medium is specified, the setting of the abnormality detection parameter corresponding to the specified medium is carried out. As the abnormality detection parameter, a threshold value of the ejection abnormality detection and the number of detection times until it is determined to be ejection abnormality are cited.

When a medium with a relatively large error of the landing position is used, by relaxing the threshold value of the ejection abnormality detection and the number of detection times until it is determined to be the ejection abnormality, determination that a state which should not be determined as ejection abnormality is determined to be ejection abnormality is suppressed.

Moreover, in correspondence with the type of the medium, an optical detection threshold value at which the dot row 402 illustrated in FIG. 9 is measured with accuracy may be set as an abnormality detection parameter. As an example of the optical detection threshold value, in a reading signal generated by reading the dot row 402 illustrated in FIG. 9, a threshold value that can determine a signal level with a line or without a line is cited. The optical detection threshold value is a mode of a measurement threshold value in the recording position information obtainment.

Such a mode is preferable that the type of the medium and the type of the parameter to be set and a relationship with the parameter value are determined and stored in advance. In such a mode, in the abnormality detection parameter setting unit 354 illustrated in FIG. 7, by using the specified type of the medium, the type of the medium and the type of the parameter to be set and the relationship with the parameter value stored in advance, the type of the parameter and the parameter value can be read out.

An ejection abnormality detection threshold value can be determined on the basis of the standard deviation $\sigma_t$ for each nozzle portion 281 expressing an error of the recording position. For example, the ejection abnormality detection threshold value for each nozzle portion 281 may be constituted by combining the recording position information for each nozzle portion 281 and the standard deviation $\sigma_t$ for each nozzle portion 281.

That is, the abnormality detection parameter setting unit 354 illustrated in FIG. 7 can set $B+A\times\sigma_t$ and $B-A\times\sigma_t$ as the abnormality detection threshold value, assuming that an average value of the recording position error for each nozzle portion 281 calculated from the recording position information for each nozzle portion 281 is B and an arbitrary constant is A.

Moreover, the abnormality detection parameter setting unit 354 illustrated in FIG. 7 can set $A\times\sigma_t$ and $-A\times\sigma_t$ as the ejection abnormality detection threshold value. In either case, the constant A can be 3 or more. The constant A can be an integer of 3 or more.

Instead of the standard deviation $\sigma_t$ for each nozzle portion 281, the average value $\sigma_{AVE}$ of the standard deviation $\sigma_t$ for each nozzle portion 281 in the plurality of nozzle portions 281 may be used. That is, the abnormality detection parameter setting unit 354 illustrated in FIG. 7 can set $A\times\sigma_{AVE}$ and $-A\times\sigma_{AVE}$ as the ejection abnormality detection threshold value.

Such a mode is preferable that, when a plurality of ejection abnormality detection modes is included, a value of the constant A is determined for each ejection abnormality detection mode, and when the ejection abnormality detection mode is set in the ejection abnormality detection mode setting unit, the value of the constant A is automatically set, and the ejection abnormality detection threshold value is automatically set in the abnormality detection parameter setting unit 354 illustrated in FIG. 7.

When the ejection abnormality detection mode is set in correspondence with a relatively high image quality, the value of the constant A is set relatively small, while when the ejection abnormality detection mode is set in correspondence with a relatively low image quality, the value of the constant A is set relatively large.

Since the value of A is set automatically in accordance with the image quality required for the image recording, the image recording using a certain reference not depending on the type of the medium or the image recording with an abnormality occurrence rate not depending on the type of the medium can be carried out.

The ejection abnormality detection threshold value may be set for each head or for each head module. That is, the ejection abnormality detection threshold value may be set for each area in which the plurality of nozzle portions 281 is contained.

Since the ejection abnormality detection threshold value is determined on the basis of the standard deviation $\sigma_t$ for each nozzle portion 281 indicating the error of the recording position, the average value $\sigma_{AVE}$ of the standard deviation $\sigma_t$ for each nozzle portion 281 in the plurality of nozzle portions 281 or the median value $\sigma_{MED}$ for the standard deviation $\sigma_t$ for each nozzle portion 281 in the plurality of nozzle portions 281, the user can execute the image recording with a defective occurrence rate suppressed to a certain level or less by the ejection abnormality detection using the ejection abnormality detection threshold value which is a certain reference not depending on the type of the medium.

[Segmentation of Medium Type]

For the medium specified to be the same type by using the medium type specification threshold value, a medium with a relatively large dot spread and relatively high optical density and a medium with a relatively small dot spread and relatively low optical density can be present.

It is preferable that different halftone rules are applied to the medium with the relatively high optical density and the medium with the relatively low optical density. Moreover, for the setting of the abnormality detection parameter, too, it is preferable that an optimal abnormality detection parameter is set for each of the mediums.

That is, for the medium specified to be the same type by using the medium type specification threshold value, the type of the medium is segmented by using the optical density, and at least either one of the recording parameter and the abnormality detection parameter can be set for each segmented medium.

Figure 10:
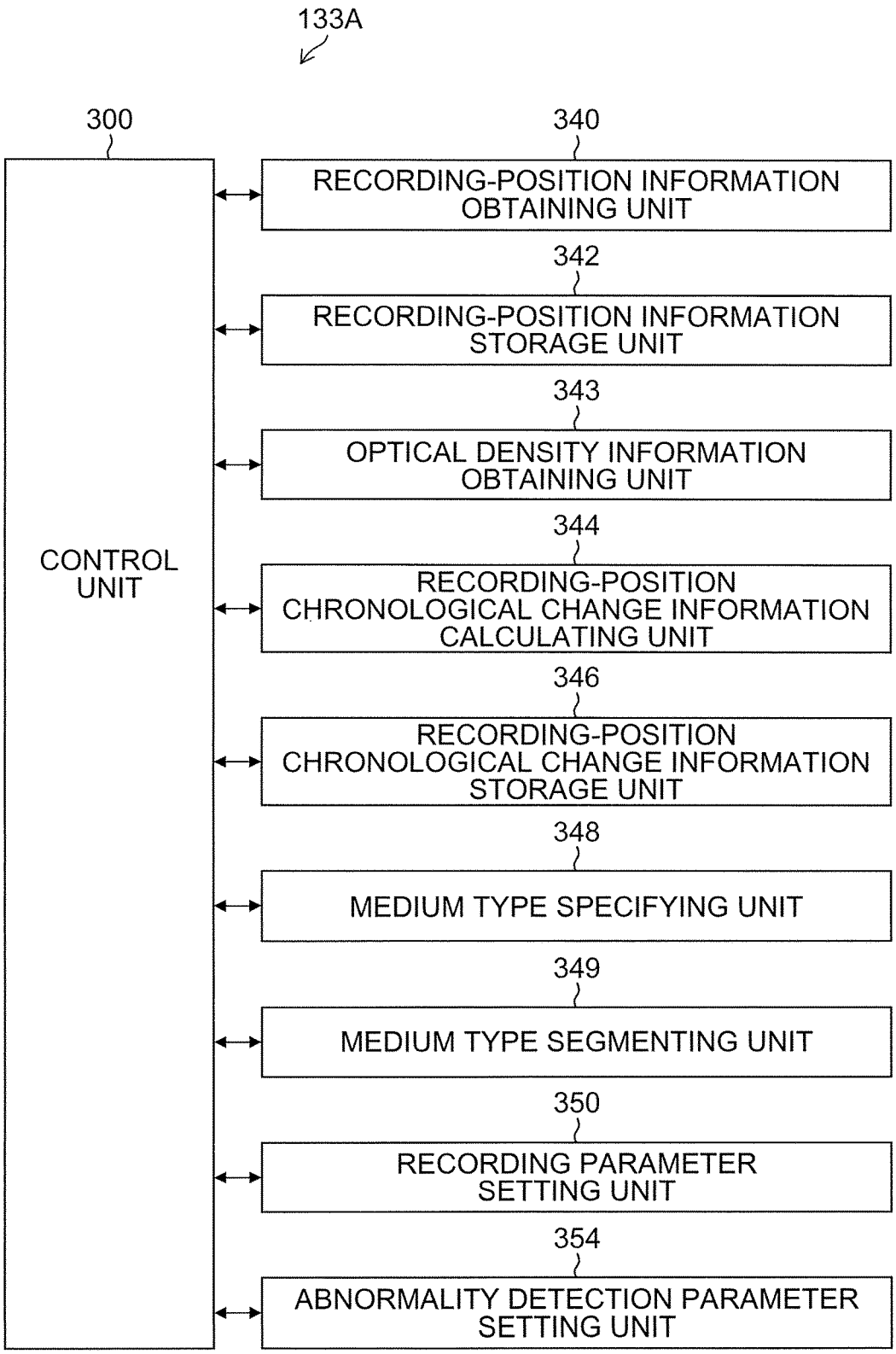
FIG. 10 is a block diagram illustrating outline configuration of a control system according to segmentation of a medium type.

FIG. 10 is a block diagram illustrating outline configuration of a control system relating to segmentation of the medium types. In reference character 133A illustrated in FIG. 10, an optical density information obtaining unit 343 and a medium type segmenting unit 349 are added to the parameter setting unit 133 illustrated in FIG. 7.

In the optical density information obtaining unit 343, the optical density information of the medium for which the recording position information is obtained is obtained. The optical density information is capable of measurement using the reading information of the pattern for optical density measurement recorded on the sheet S.

In the medium type segmenting unit 349, by using the optical density information obtained by using the optical density information obtaining unit 343, the type of the medium specified in the medium type specifying unit 348 is segmented.

Figure 11:
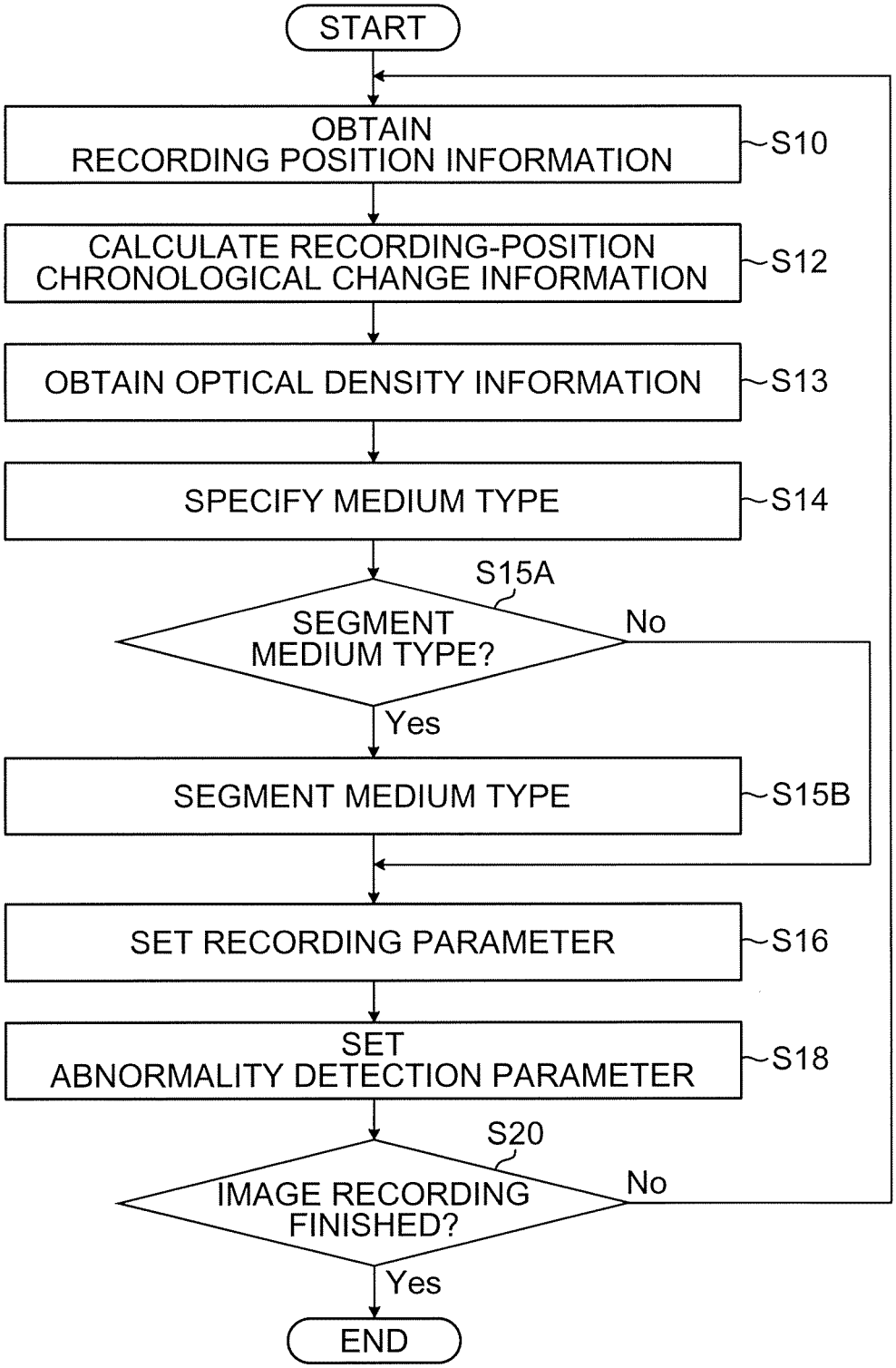
FIG. 11 is a flowchart illustrating a procedure of the parameter setting method according to the segmentation of the medium type.

FIG. 11 is a flowchart illustrating a procedure of a parameter setting method relating to segmentation of the medium type. In the flowchart illustrated in FIG. 11, an optical density information obtaining process S13, a medium type segmentation determining process S15A, and a medium type segmenting process S15B are added to the flowchart illustrated in FIG. 8.

At the optical density information obtaining process S13, the optical density information is measured by using the optical density information obtaining unit 343 illustrated in FIG. 10.

At the medium type segmentation determining process S15A, for the medium whose type is specified at the medium type specifying process S14, whether segmentation is needed or not is determined. The determination on whether the segmentation is needed or not is made such that a medium requiring segmentation is registered in advance, and if the medium whose type is specified at the medium type specifying process S14 is registered as the medium requiring segmentation, the routine proceeds to the medium type segmenting process S15B.

On the other hand, the medium whose type is specified at the medium type specifying step S14 is not registered as the medium requiring segmentation, at least either one of the recording parameter setting step S16 and the abnormality detection parameter setting step S18 may be executed.

In other words, in the case of YES determination at the medium type segmentation determining step S15A, the routine proceeds to the medium type segmenting step S15B. In the case of NO determination at the medium type segmentation determining step S15A, the routine proceeds to the recording parameter setting step S16.

At the medium type segmenting process S15B, from a relationship between the optical density registered in advance and the segmentation information of the medium, the segmentation information of the medium is read out by using the optical density information obtained at the optical density information obtaining process S13 as an index. By using the read-out segmentation information, the type of the medium is specified.

According to the segmentation of the medium type, since the specified type of the medium is further segmented and specified, more preferable setting of the recording parameter and setting of the abnormality detection parameter can be made by further segmentation and specification of the specified type of medium. The optical density information obtaining process S13 illustrated in FIG. 11 may be executed in the case of the YES determination at the medium type segmentation determining process S15A.

Since the type of the medium is segmented and specified as described above, improvement in accuracy of the specification of the type of the medium is expected. Moreover, setting of at least either one of the recording parameter more suitable to the type of the medium and the abnormality detection parameter can be made.

[Variation]

In this embodiment, the mode in which the recording position information is obtained, the recording-position chronological change information is calculated, the type of the medium is specified, and at least either one of the recording parameter and the abnormality detection parameter is set by using the specified type of the medium is exemplified, but a mode in which at least either one of the recording parameter and the abnormality detection parameter is set from the recording-position chronological change information without specifying the type of the medium can be used.

In this embodiment, the inkjet-type image recording including the liquid ejection head including the nozzle portion which causes the liquid to be ejected is exemplified, but the aforementioned image recording method may be applied to an electrophotography type image recording including an electrophotography type recording head.

[Description of Working Effect]

According to the image recording apparatus and the parameter setting method constituted as above, since the chronological change information of the recording position which indicates the chronological change of the recording position is calculated, and the type of the medium is specified by using the calculated recording-position chronological change information, the specification of the type of the medium is prevented from depending on the user.

Moreover, since the recording parameter corresponding to the specified type of the medium and the abnormality detection parameter are automatically set, manual setting by the user is not carried out and improvement of usability is expected.

Moreover, if the recording parameter corresponding to the type of the medium is set, an increase in an unnecessary mask applied to correction is suppressed. Furthermore, insufficient correction and excessive correction caused by setting of the mask are suppressed.

The embodiment of the present invention described above is capable of change, addition or deletion of a constituent requirement as appropriate within a range not departing from the gist of the present invention. The present invention is not limited to the embodiment described above but is capable of many variations by those having ordinary knowledge of the field concerned within the technical idea of the present invention.

What is claimed is:

1. An image recording apparatus comprising:

a recording head including a plurality of recording elements;

a recording-position information obtaining unit configured to obtain recording position information a plurality of times at an interval of an arbitrary period, the recording position information including information on an actual recording position in each of the plurality of recording elements included in the recording head;

a recording-position chronological change information calculating unit configured to calculate chronological change information of the recording position of each recording element by using the recording-position information of each recording element obtained in the recording-position information obtaining unit;

a medium type specifying unit configured to specify a type of a medium by using the chronological change information of the recording position of each recording element calculated in the recording-position chronological change information calculating unit; and a parameter setting unit configured to automatically set a recording parameter including at least any one of an output gradation value, an abnormal recording element correction coefficient, an uneven density correction coefficient, and a halftone processing rule in correspondence with the type of the medium specified in the medium type specifying unit, automatically set an abnormality detection parameter including at least any one of a measurement threshold value in recording-position information obtainment, an abnormality detection threshold value used for abnormality detection, and an abnormality detection procedure used for abnormality detection or automatically set both the recording parameter and the abnormality detection parameter.

2. The image recording apparatus according to claim 1, wherein the recording-position information obtaining unit obtains a result of reading a recording position measurement pattern by using a reading device as recording position information, the recording position measurement pattern being recorded in the medium by using the recording head.

3. The image recording apparatus according to claim 1, wherein the recording-position chronological change information calculating unit calculates an average value of the chronological change information of the plurality of recording elements or a median value of the chronological change information of the plurality of recording elements, and the medium type specifying unit specifies the type of the medium by using the average value of the chronological change information of the plurality of recording elements calculated by using the recording-position chronological change information calculating unit or the median value of the chronological change information of the plurality of recording elements calculated by using the recording-position chronological change information calculating unit.

4. The image recording apparatus according to claim 1, wherein the recording-position information obtaining unit obtains the recording position information measured at an arbitrary timing by using a standard medium, the recording-position chronological change information calculating unit calculates the recording-position chronological change information corresponding to the standard medium by using the recording position information measured when the standard medium is used, and the medium type specifying unit sets a threshold value used when the type of the medium is specified and corrects the set threshold value used when the type of medium is specified by using the recording-position chronological change information corresponding to the standard medium.

5. The image recording apparatus according to claim 4, wherein the medium type specifying unit determines necessity of correction of a threshold value set and used when the type of the medium is specified by using the recording position information in the plurality of recording elements obtained in one session in the recording position information when the standard medium is used.

6. The image recording apparatus according to claim 1, further comprising:

an optical density information obtaining unit configured to obtain optical density information; and a medium type segmenting unit configured to segment and specify the type of the medium specified by using the medium type specifying unit by using the optical density information obtained by using the optical density information obtaining unit.

7. The image recording apparatus according to claim 1, wherein the parameter setting unit sets the abnormality detection parameter in which actual recording position information for each recording element obtained by using the recording-position information obtaining unit and the recording-position chronological change information for each recording element calculated by using the recording-position chronological change information calculating unit are used.

8. The image recording apparatus according to claim 7, wherein the parameter setting unit sets the abnormality detection parameter in which an average value of the recording-position chronological change information of the plurality of the recording elements calculated by using the recording-position chronological change information calculating unit or a median value of the recording-position chronological change information of the plurality of the recording elements calculated by using the recording-position chronological change information calculating unit are used.

9. The image recording apparatus according to claim 7, wherein the parameter setting unit sets $B+A\times\sigma_t$ and $B-A\times\sigma_t$ as the abnormality detection threshold value, where an arbitrary constant is A, an average value of the actual recording position for each recording element obtained by using the recording-position information obtaining unit is B, and a standard deviation for an error of the recording position for each recording element is $\sigma_t$.

10. The image recording apparatus according to claim 9, wherein the parameter setting unit sets a value of the constant A relatively small when the setting of an image quality is a relatively high image quality and sets the value of the constant A relatively large when the setting of the image quality is a relatively low image quality, where the constant A is a positive number.

11. A parameter setting method in an image recording apparatus including a recording head including a plurality of recording elements, the parameter setting method comprising:

a recording-position information obtaining step of obtaining recording position information a plurality of times at an interval of an arbitrary period, the recording position information including information on an actual recording position in each of the plurality of recording elements included in the recording head;

a recording-position chronological change information calculating step of calculating chronological change information of the recording position of each recording element by using the recording-position information of each recording element obtained in the recording position information obtaining step;

a medium type specifying step of specifying a type of a medium by using the chronological change information of the recording position of each recording element calculated in the recording-position chronological change information calculating step; and a parameter setting step of automatically setting a recording parameter including at least any one of an output gradation value, an abnormal recording element correction coefficient, an uneven density correction coefficient, and a halftone processing rule in correspondence with the type of the medium specified in the medium type specifying step, automatically setting an abnormality detection parameter including at least any one of a measurement threshold value in recording-position information obtainment, an abnormality detection threshold value used for abnormality detection, and an abnormality detection procedure used for abnormality detection or automatically setting both the recording parameter and the abnormality detection parameter.

* * * * *